US010421083B2

(12) United States Patent
Winter et al.

(10) Patent No.: US 10,421,083 B2
(45) **Date of Patent: *Sep. 24, 2019**

(54) IMMERSIVE SHOWERHEAD

(71) Applicant: Nebia Inc., San Francisco, CA (US)

(72) Inventors: Philip Winter, San Francisco, CA (US); Carlos Gomez Andonaegui, San Francisco, CA (US); Gabriel Parisi-Amon, San Francisco, CA (US); Corey Lynn Murphey, San Francisco, CA (US); David Shulman, San Francisco, CA (US); Emilio Gomez, San Francisco, CA (US)

(73) Assignee: Nebia, Inc., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/895,913

(22) Filed: Feb. 13, 2018

(65) Prior Publication Data

US 2018/0169671 A1 Jun. 21, 2018

Related U.S. Application Data

(63) Continuation of application No. 15/273,684, filed on Sep. 22, 2016, now Pat. No. 9,931,651, which is a (Continued)

(51) Int. Cl.
*B05B 1/18* (2006.01)
*B05B 1/12* (2006.01)
(Continued)

(52) U.S. Cl.
CPC ..... *B05B 1/185* (2013.01); *B05B 1/12* (2013.01); *B05B 1/16* (2013.01); *B05B 1/169* (2013.01);
(Continued)

(58) Field of Classification Search
CPC .. B05B 1/02; B05B 1/04; B05B 1/042; B05B 1/044; B05B 1/06; B05B 1/12; B05B 1/16; B05B 1/169; B05B 1/18; B05B 1/185
See application file for complete search history.

(56) References Cited

U.S. PATENT DOCUMENTS 6,270,022 B1 * 8/2001 Knapp ..... B05B 7/0425 239/428.5
6,739,527 B1 * 5/2004 Chung ..... B05B 1/185 239/558
(Continued)

*Primary Examiner* — Darren W Gorman
(74) *Attorney, Agent, or Firm* — Run8 Patent Group, LLC; Peter Miller

(57) ABSTRACT

One variation of a showerhead includes: a body defining a fluid circuit, a first region on a ventral side of the body, and a second region adjacent the first region on the ventral side of the body; a set of hollow cone nozzles distributed within the first region, fluidly coupled to the fluid circuit, and discharging sprays of fluid droplets within a first size range; a set of flat fan nozzles arranged within the second region, fluidly coupled to the fluid circuit, and discharging sprays of fluid droplets within a second size range; and a set of orifices fluidly coupled to the fluid circuit and discharging fluid drops between sprays discharged from the set of hollow cone nozzles and sprays discharged from the flat fan nozzles, fluid drops discharged from the set of orifices within a third size range exceeding the first size range and the second size range.

20 Claims, 15 Drawing Sheets

Related U.S. Application Data continuation-in-part of application No. 14/814,721, filed on Jul. 31, 2015, now Pat. No. 9,925,545.

(60) Provisional application No. 62/043,095, filed on Aug. 28, 2014.

(51) Int. Cl.
*B05B 1/16* (2006.01)
*B05B 1/04* (2006.01)
*B05B 1/06* (2006.01)

(52) U.S. Cl.
CPC ..... *B05B 1/18* (2013.01); *B05B 1/04* (2013.01); *B05B 1/06* (2013.01)

(56) References Cited

U.S. PATENT DOCUMENTS

2004/0074993 A1* 4/2004 Thomas ..... B05B 1/1663 239/525
2016/0059240 A1* 3/2016 Rexach ..... B05B 1/18 239/562

* cited by examiner

IMMERSIVE SHOWERHEAD

CROSS-REFERENCE TO RELATED APPLICATIONS

This Application is a continuation of Ser. No. 15/273,684, filed on 22 Sep. 2016, which is a continuation-in-part application of U.S. patent application Ser. No. 14/814,721, filed on 31 Jul. 2015, which claims the benefit of U.S. Provisional Application No. 62/043,095, filed on 28 Aug. 2014, all of which are incorporated in their entireties by this reference.

TECHNICAL FIELD

This invention relates generally to the field of bathing systems and more specifically to a new and useful immersive showerhead in the field of bathing systems.

DESCRIPTION OF THE EMBODIMENTS

The following description of the embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Showerhead

Figure 1:
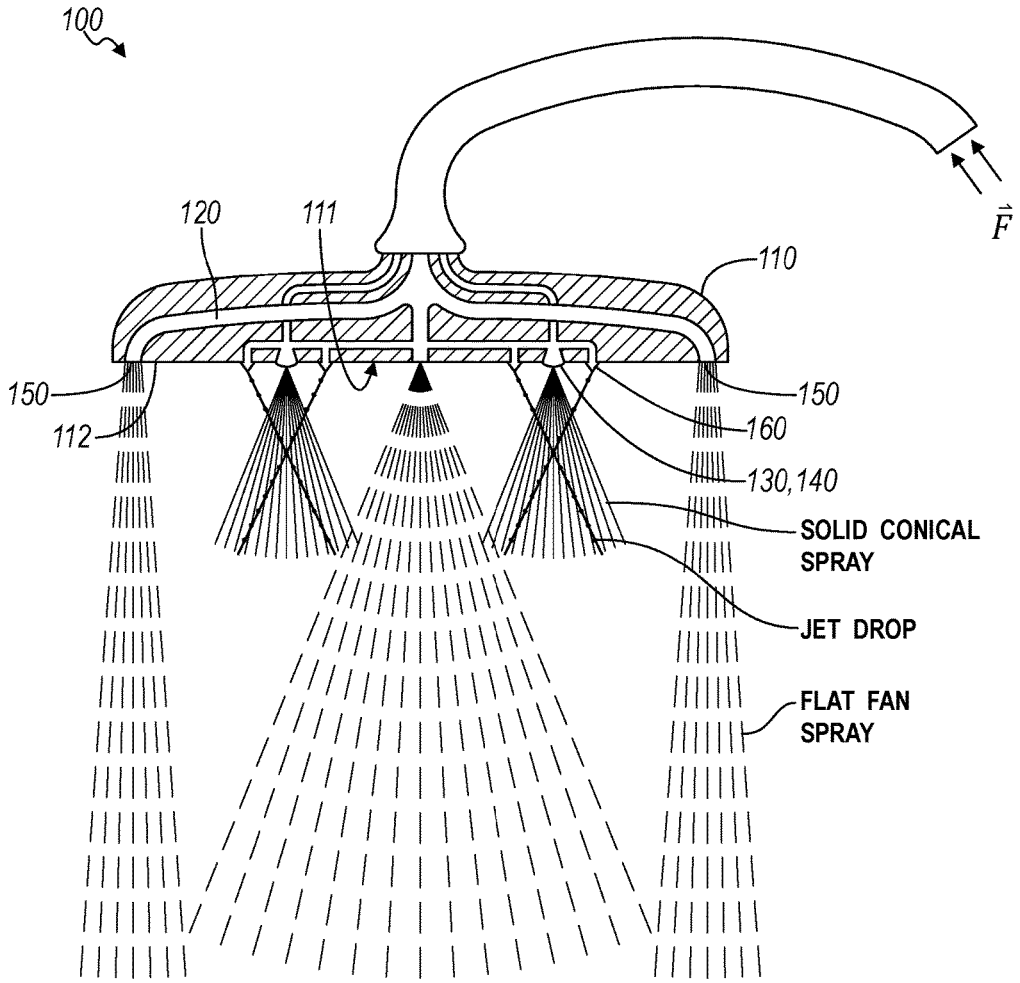
FIG. 1 is a schematic representation of a showerhead.

As shown in FIG. 1, a showerhead 100 includes: a body 110 defining a fluid circuit 120, a first region 111 on a ventral side of the body 110, and a second region 112 adjacent the first region 111 on the ventral side of the body 110; a set of hollow cone nozzles 130 distributed within the first region 111, fluidly coupled to the fluid circuit 120, and discharging sprays of fluid droplets within a first size range; a set of flat fan nozzles 150 arranged within the second region 112, fluidly coupled to the fluid circuit 120, and discharging sprays of fluid droplets within a second size range; and a set of orifices fluidly coupled to the fluid circuit 120 and discharging fluid drops between sprays discharged from the set of hollow cone nozzles 130 and sprays discharged from the flat fan nozzles 150, fluid drops discharged from the set of orifices within a third size range exceeding the first size range and the second size range.

One variation of the showerhead 100 includes: a first member 113 defining a first channel 124 and an inlet communicating fluid to the first channel 124; a second member 114 extending from the first member 113 and defining a second channel 125 fluidly coupled to the first channel 124; a first set of nozzles fluidly coupled to the first channel 124, discharging fluid droplets in discrete fine mist sprays, and including a first nozzle, a second nozzle, and a third nozzle distributed across the first member 113, the second nozzle offset laterally from the first nozzle, the third nozzle centered laterally between and longitudinally offset from the first nozzle and the second nozzle toward an anterior end of the first member 113; and a second set of nozzles fluidly coupled to the second channel 125, discharging fluid droplets in discrete heavy mist sprays, and distributed across the second member 114.

Figure 16:
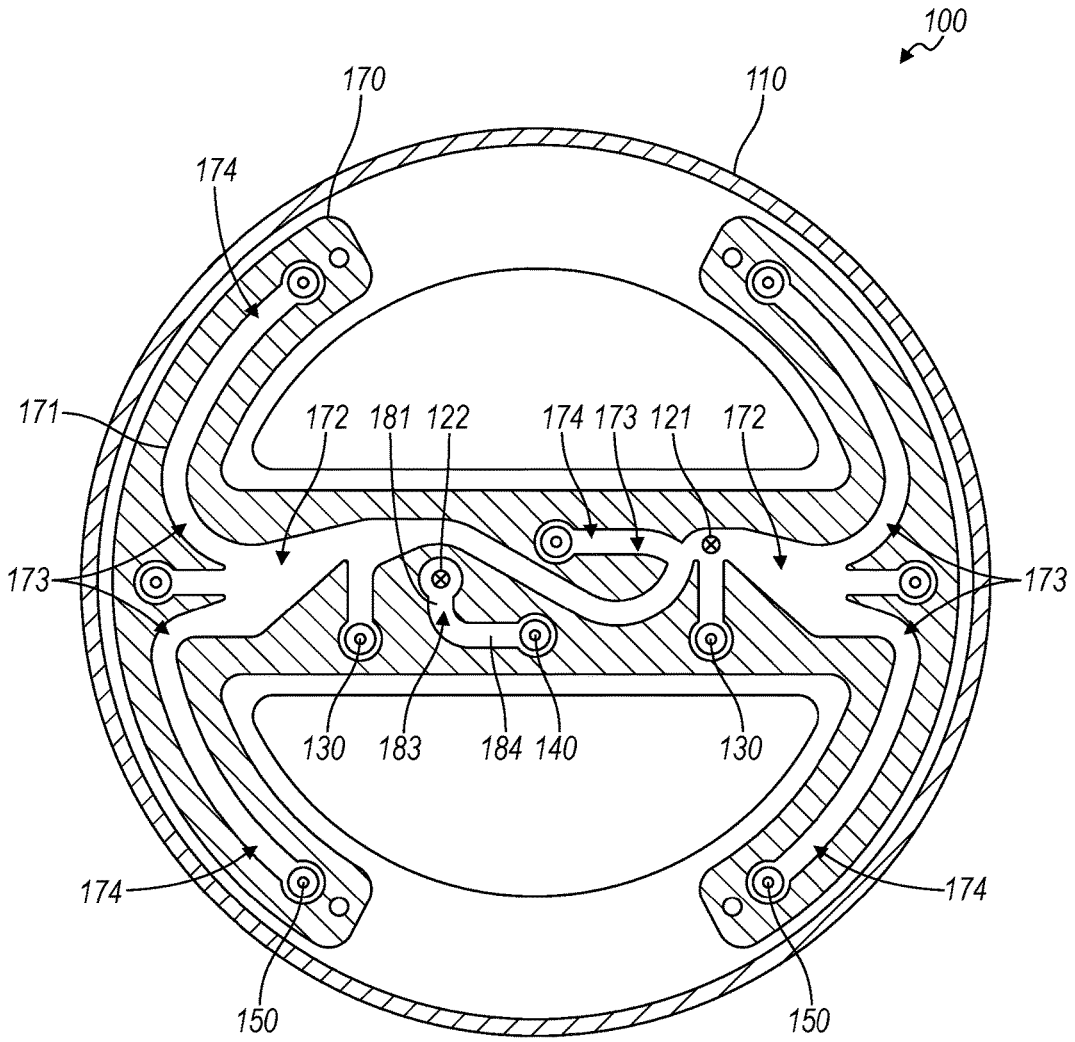
FIG. 16 is a schematic representation of one variation of the showerhead.

As shown in FIG. 16, one variation of the showerhead 100 includes: a body 110; and a fluid circuit insert 170. In this variation, the body 110 includes a ventral side and a dorsal side, wherein the ventral side of the body 110 defines a set of orifices. The fluid circuit insert 170 is housed within the body 110 and includes: a first inlet port adjacent the dorsal side of the body 110 and configured to receive fluid under pressure; a first set of nozzles, each nozzle in the first set of nozzles defining an inlet facing the dorsal side of the body 110 and an outlet facing an orifice in the set of orifices; a first set of entry transitions, each entry transition 174 in the first set of entry transitions substantially coaxial with a nozzle in the first set of nozzles, extending substantially vertically from an inlet of the nozzle toward the dorsal side of the body 110, and defining a length greater than a minimum vertical flow length; a manifold 172 extending laterally from the first inlet port toward each entry transition 174 in the first set of entry transitions substantially perpendicular to axes of the first set of entry transitions; and a first set of branches, each branch 173 in the first set of branches extending laterally from the manifold 172, terminating at one entry transition 174 in the first set of entry transitions, and defining a length greater than a minimum entrance length.

Figure 17:
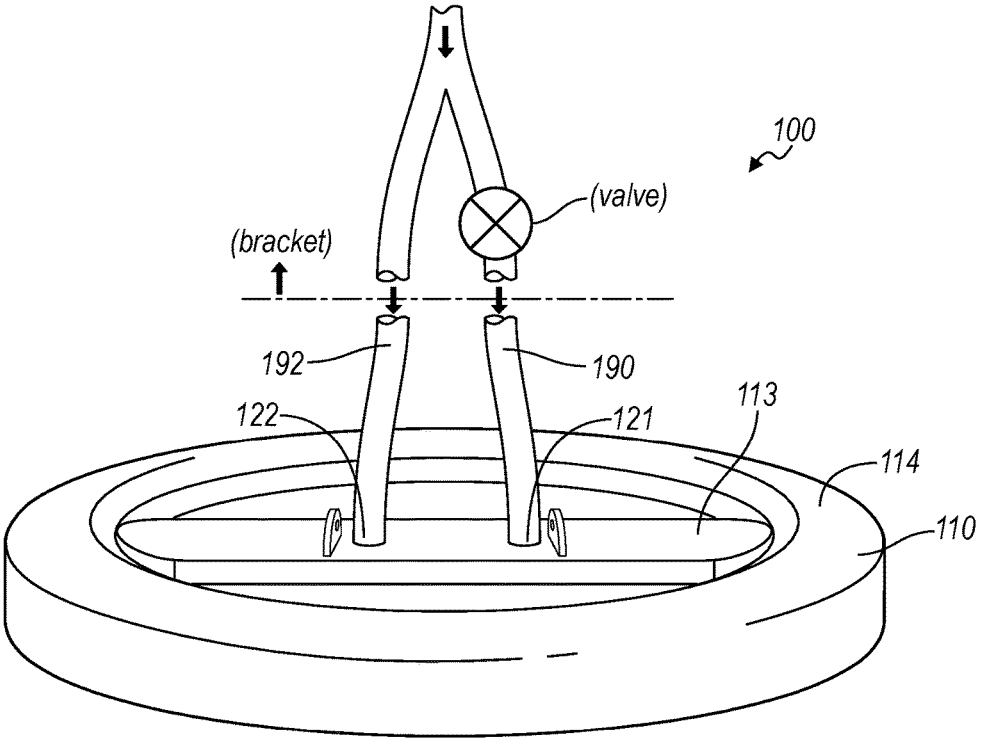
FIG. 17 is a schematic representation of one variation of the showerhead.

As shown in FIGS. 16 and 17, a similar variation of the showerhead 100 includes: a body 110 including a ventral side and a dorsal side; a first fluid circuit 171 arranged within the body 110; and a second fluid circuit 181 arranged within the body 110. The first fluid circuit 171 includes: a first inlet port adjacent the dorsal side of the body 110 and configured to receive fluid under pressure; a first set of nozzles, each nozzle in the first set of nozzles defining an inlet facing the dorsal side of the body 110 and an outlet facing the ventral side of the body 110; a first set of entry transitions, each entry transition 174 in the first set of entry transitions substantially coaxial with a nozzle in the first set of nozzles and extending substantially vertically from an inlet of the nozzle toward the dorsal side of the body 110; a manifold 172 extending laterally from the first inlet port toward each entry transition 174 in the first set of entry transitions substantially perpendicular to axes of the first set of entry transitions; and a first set of branches, each branch 173 in the first set of branches extending laterally from the manifold 172 and terminating at one entry transition 174 in the first set of entry transitions. The second fluid circuit 181 includes: a second inlet port adjacent the first inlet port and configured to receive fluid under pressure; a second nozzle defining a second inlet port facing the dorsal side of the body 110 and a second outlet facing the dorsal side of the body 110; a second entry transition 184 substantially coaxial with a nozzle in the first set of nozzles and extending substantially vertically from the second inlet port of the second nozzle toward the dorsal side of the body 110; and a second branch 183 fluidly coupled to the second inlet port, extending laterally, and terminating at the second entry transition 184.

2. Applications

Generally, the showerhead 100 functions to discharge water droplets within a bathing environment. In particular, the showerhead 100 includes a combination of hollow cone nozzles, full cone nozzles, and/or flat fan nozzles that—compared to a classical showerhead that discharges water drops typically greater than 1000 micrometers in width—discharge a range of relatively small droplets of water that remain suspended in air within the bathing environment for relatively longer durations of time—due to their relatively higher drag coefficients—to form a cloud of heated moisture that engulfs a bather (or a "user"). The showerhead 100 can discharge fine mist sprays of water from one or more hollow cone nozzles to create a cloud of fine droplets that that conduct and radiate heat into the bather, ambient air, and adjacent surfaces due to their relatively small size and relatively high surface-area-to-volume ratios compared to drops discharged from classical showerheads. Thus, by discharging fluid droplets of a relatively small size into the bathing environment, the showerhead 100 can achieve relatively greater heat extraction from water discharged from these nozzles by the time these droplets coalesce at the floor of a shower and run down a drain.

The showerhead 100 can also discharge a range of fluid droplet sizes in select spray geometries and positions to improve heat retention within a bathing environment. In particular, the showerhead 100 can include flat fan nozzles that discharge flat fan sprays of water droplets—of average size larger than those discharged from the hollow cone nozzles—that intersect below the showerhead 100 to form a continuous curtain of larger fluid droplets around the cloud of fine(r) fluid droplets. This larger droplets discharged from the full cone nozzles can retain more heat over longer time durations and/or over greater distances from the showerhead 100 than the smaller droplets discharged from the hollow cone nozzles, thereby thermally shielding the interior cloud of finer droplets from ambient air and adjacent surfaces. In particular, the flat fan nozzles discharge larger droplets that cooperate to form an adiabatic boundary layer that shields smaller droplets within the bathing environment from nearby cooler surfaces and ambient air, which may otherwise absorb heat from these smaller droplets and cool the bathing environment relatively rapidly. The showerhead 100 can therefore discharge a combination of relatively fine droplets and larger droplets in a particular pattern to create and maintain a bathing environment exhibiting a higher average temperature and a higher average humidity than ambient air around the bathing environment.

Figure 12A:
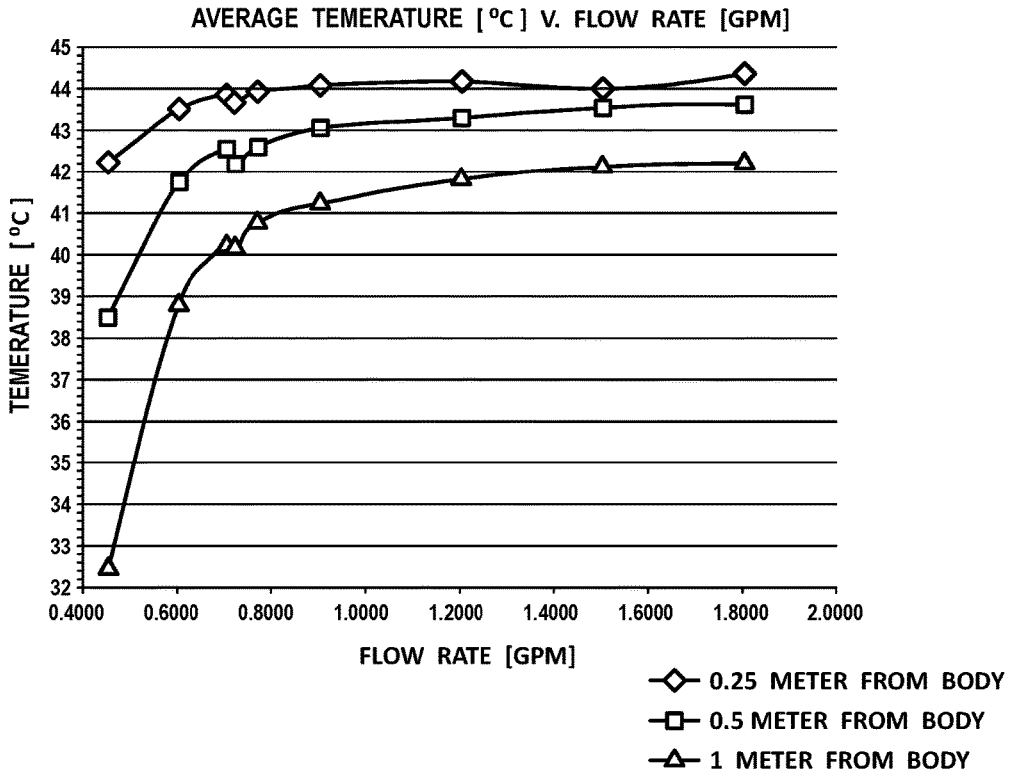
FIGS. 12A and 12B are graphical representations of variations of the showerhead.
Figure 12B:
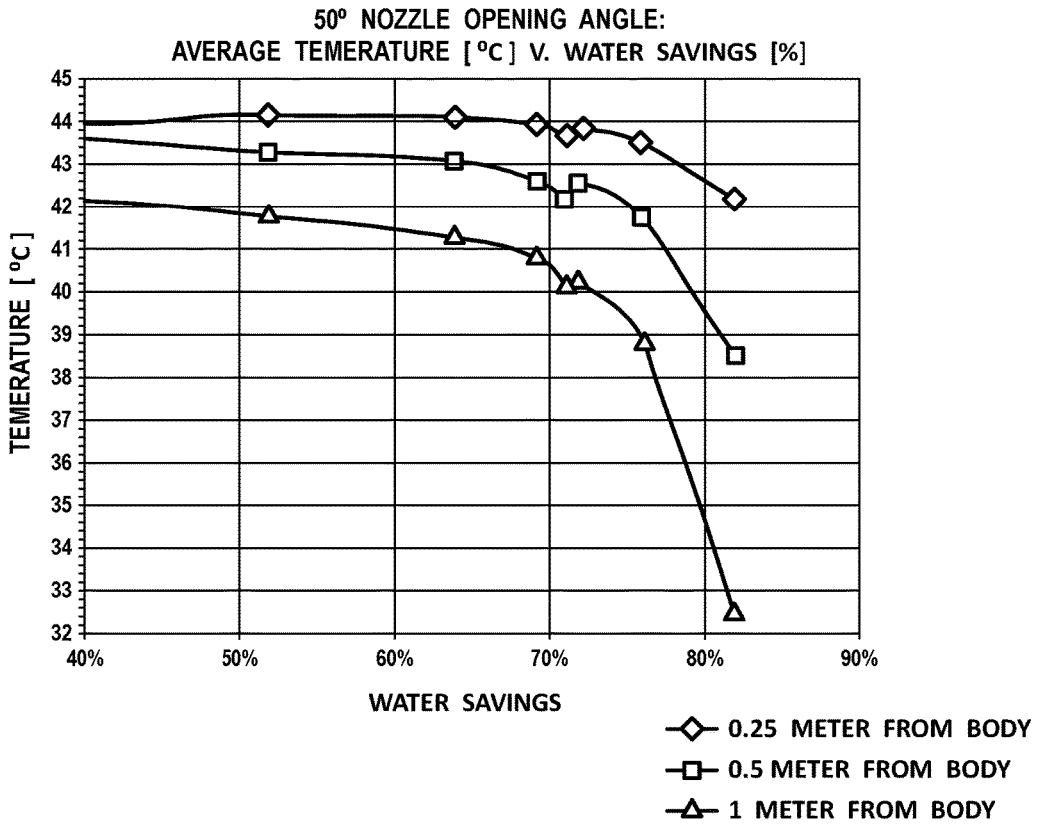

The showerhead 100 can include one or more hollow cone nozzles, full cone nozzles, and/or flat fan nozzles that discharge relatively small fluid droplets (e.g., between 150 micrometers and 300 micrometers in width (e.g., a "fine" mist spray), between 350 micrometers and 500 micrometers in width, and between 350 micrometers and 800 micrometers in width (e.g., a "heavy" mist spray), respectively. These nozzles can define relatively small orifices that together yield a lower total volume flow rate through the showerhead 100 than classical showerheads that discharge relatively large water droplets (e.g., greater than 1000 micrometers in width). Therefore, for a cloud of water droplets discharged from the showerhead 100, volumetric fluid flux through a plane offset below the showerhead 100 may be less than volumetric fluid flux through a plane similarly offset below a classical showerhead under similar water supply conditions (e.g., similar water pressure, similar water temperature); however, total fluid mass in a volume offset below the showerhead 100 (e.g., within the bathing environment) may be substantially similar to a total fluid mass in a similar volume offset below the classical showerhead under such similar water supply conditions due to longer flight times of relatively smaller fluid droplets discharged from the showerhead 100. The showerhead 100 can therefore exhaust less water per unit time in operation than a classical showerhead under similar water supply conditions but still wet the bather with similar volumes of water as similar temperatures. Furthermore, the showerhead 100 includes a combination of hollow cone nozzles (and/or full cone nozzles) and flat fan nozzles that cooperate to form a shielded bathing environment such that the showerhead 100 yields similar heat flux into the bather per unit time in operation compared to a classical showerhead despite the reduced water consumption of the showerhead 100. For example, the showerhead 100 can discharge fluid droplets at a total flow rate of 0.8 gallons per minute (or "gpm") through a combination of hollow cone, full cone, and/or flat fan nozzle. These fluid droplets can form a droplet cloud exhibiting average temperatures within thin cross-sectional volumes at various distances from the body that approximate average temperatures exhibited by streams of water discharged from a classical shower head at a significantly greater flow rate, as shown in FIGS. 12A and 12B.

The showerhead 100 can also include one or more jet orifices 160 that inject even larger fluid drops, such as between 800 micrometers and 3000 micrometers in width, into sprays discharged from an hollow cone nozzle, a full cone nozzle, or a flat fan nozzle. In particular, the showerhead 100 can include a set of jet orifices 160 that discharge larger fluid drops toward sprays of smaller droplets discharged from other nozzles. Due to their larger size and lower surface-area-to-volume ratios, these larger drops can retain heat over longer distances from the showerhead 100 and can communicate heat into local, smaller droplets, thereby maintaining higher average temperatures across slices or volumes of the bathing environment (i.e., within the curtain of fluid droplets) at greater distances from the showerhead 100. The jet orifices 160 can discharge these larger drops at discharge velocities less than those of the hollow cone, full cone, and/or flat fan sprays. These larger drops remain airborne over durations of time nearing airborne durations of the smaller droplets and carry momentum approximating the average momentum of adjacent volumes of smaller droplets, thereby yielding greater heat extraction from the larger drops between the body and the floor of a shower. These larger droplets also heat adjacent volumes of smaller drops to maintain more uniform and higher average temperatures within the bathing environment and preserve a soft, low-impact cloud of fluid droplets within bathing environment due to their lower discharge velocities.

Figure 18:
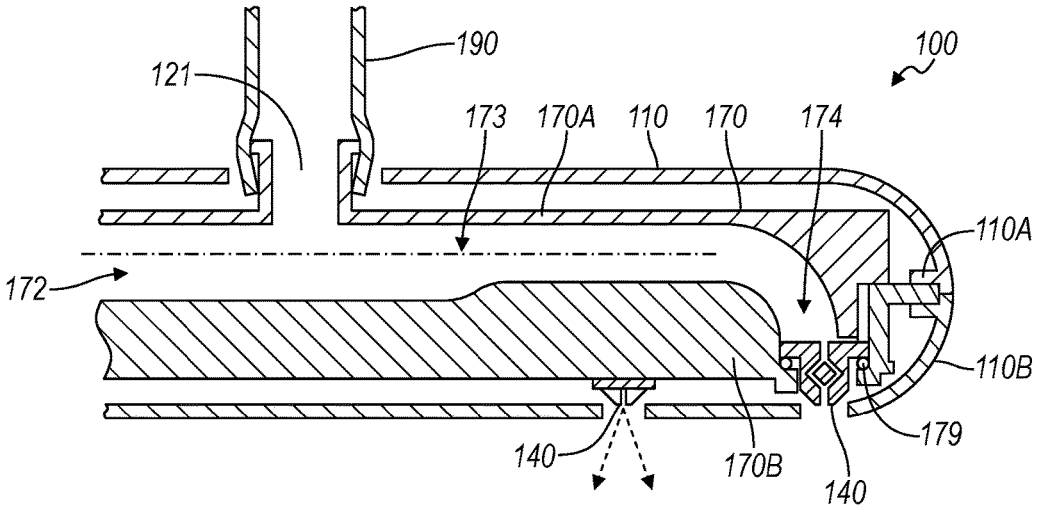
FIG. 18 is a schematic representation of one variation of the showerhead.

As shown in FIGS. 16 and 18, the showerhead 100 can include a fluid circuit insert 170 that defines an inlet, a manifold 172, and a set of discrete flow paths from the manifold 172 to each of a set of nozzles. Generally, turbulent flow, such as cavitation, occurring at the entry of a nozzle may cause fluttering (or "sputtering"), non-uniform droplet size, and varying spray angle in a spray of fluid discharged from the nozzle. Flow that is not fully developed—that is, flow that has not reached a fully developed velocity profile in which flow across the cross-section of a flow path has reached a substantially constant, substantially coaxial velocity—upon entry into a nozzle may similarly yield fluttering, non-uniform droplet size, and varying spray angle in the spray discharged from the nozzle. Inconsistent fluid flow upstream of a nozzle may cause non-uniform distribution of droplets across a spray discharged from the nozzle (i.e., non-uniform distribution strength lines in the droplet spray discharged from the nozzle), wherein various regions of the spray may exhibit greater concentrations of droplets than other regions of the spray. Furthermore, because flow rate, spray angle, and droplet size of fluid discharged from such a nozzle may be a function of inlet pressure, sputtering at this one nozzle may induce variations of backpressure in the fluid circuit 171 that also result in varying flow rates, spray angles, and droplet sizes of fluid discharge from other nozzles in the showerhead 100, thereby yielding an inconstant or erratic shower experience. Therefore, each discrete flow path extending from the manifold 172 to a corresponding nozzle can define a length and a cross-section sufficient for fluid—flowing from the manifold 172 into the corresponding nozzle—to fully develop before reaching the inlet of the corresponding nozzle. In particular, each discrete flow path can define a length greater than or equal to an entrance length for which the velocity profile of fluid flowing through the flow path fully develop, such as into a parabolic velocity profile for laminar flow through the flow path. Each pathway can also extend to and terminate at a single nozzle, thereby minimizing an effect of fluid flow through one nozzle on fluid flow through another nozzle in the showerhead 100.

Figure 14:
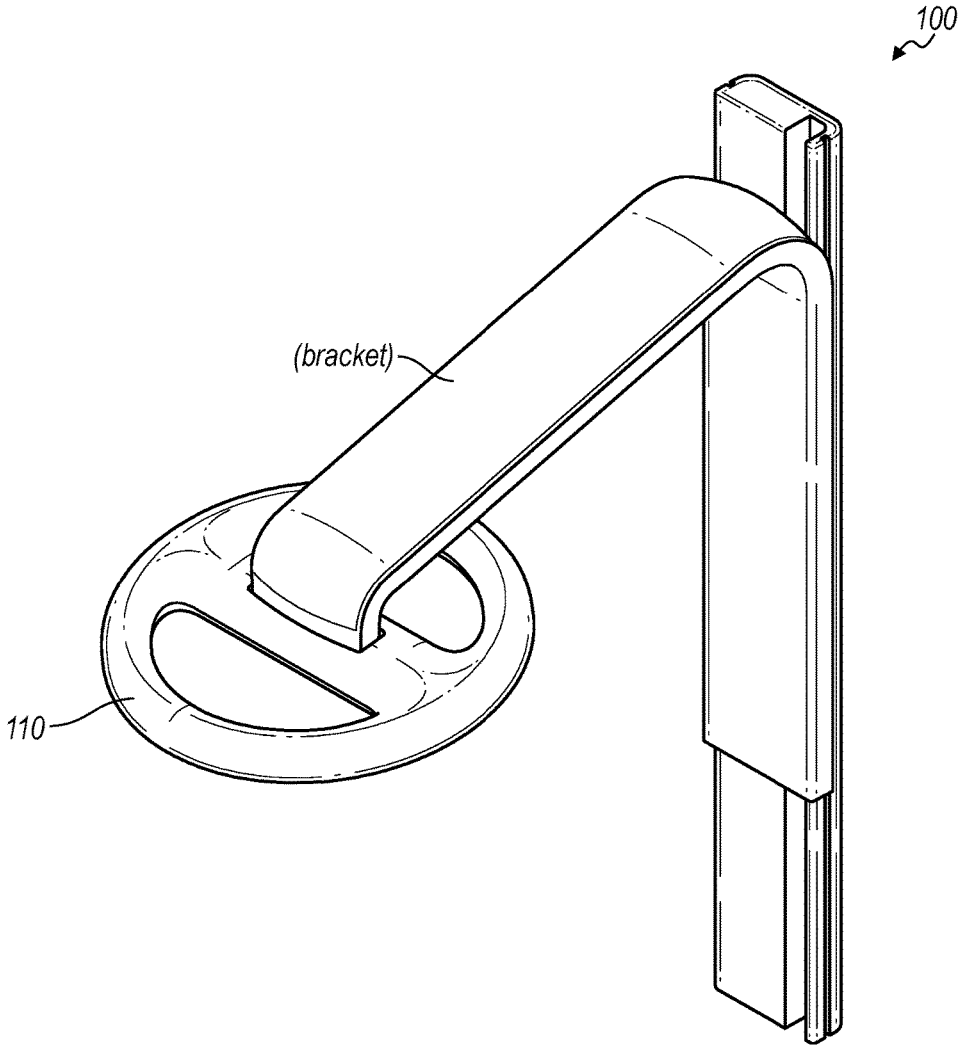
FIG. 14 is a schematic representation of one variation of the showerhead.

Furthermore, as shown in FIG. 14, the showerhead 100 can define a short cylindrical (or "pancake") geometry with fluid entering the showerhead 100 at an inlet on its dorsal (i.e., top) side and exiting from multiple nozzles on the ventral side (i.e., bottom) of the showerhead 100 in the form of multiple fluid droplet sprays. Therefore, the manifold 172 and flow paths can cooperate to move fluid laterally from a common inlet on the dorsal side of the showerhead 100 to nozzles distributed about the ventral side of the showerhead 100. Each flow path can also redirect flow in a direction coaxial with the inlet of its corresponding nozzle—in order for flow to reach a fully-developed condition before entering the nozzle—within a limited vertical distance restricted by the total height of the showerhead 100, which may be significantly less than (e.g., less than 25% of) the width of the showerhead 100.

The showerhead 100 can be installed on a fluid supply neck extending from a wall or a ceiling within a shower, such as within a bathroom. The showerhead 100 is described herein as defining an anterior (i.e., front) end that faces a control wall or "front" of the shower when installed, and the showerhead 100 is described herein as discharging fluid droplets downward onto a user standing below the showerhead 100 and facing the front of the shower—that is, standing below a ventral side of the showerhead 100 and facing the anterior end of the showerhead 100. However, the showerhead 100 can be installed in any other environment and in any other way, and the showerhead 100 can include an arrangement of nozzles that discharge fluid droplets toward a user positioned in any other way proximal the showerhead 100, such as sitting or standing above, below, or to the side of the showerhead 100 and in any angular position (i.e., yaw angle) relative to the showerhead 100.

Furthermore, the showerhead 100 is described herein as a unit that is installed in a bathing environment. However, the showerhead 100 can additionally or alternatively include handheld unit, such as a shower wand, that similarly includes one or more hollow cone nozzles, full cone nozzles, flat fan nozzles, and/or jet orifices 160, as described below.

3. Body

The showerhead 100 includes a body 110 defining a fluid circuit 120, a first region 111 on a ventral side of the body 110, and a second region 112 adjacent the first region 111 on the ventral side of the body 110. Generally, the body 110 defines a housing that supports discrete and/or integrated nozzles and defines an internal fluid circuit 120 that distributes fluid (e.g., water) from one or more inlets to corresponding nozzles during operation.

Figure 3:
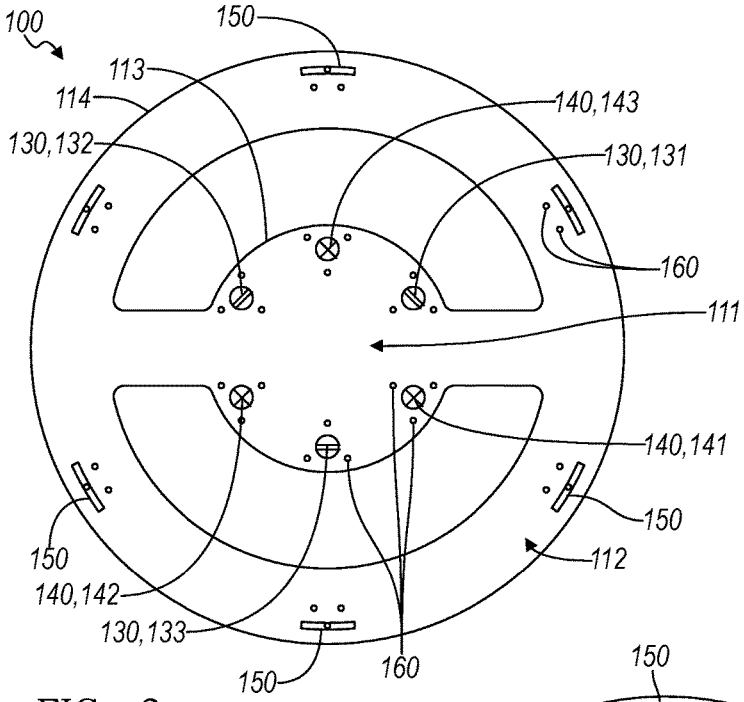
FIG. 3 is a schematic representation of one variation of the showerhead.
Figure 4:
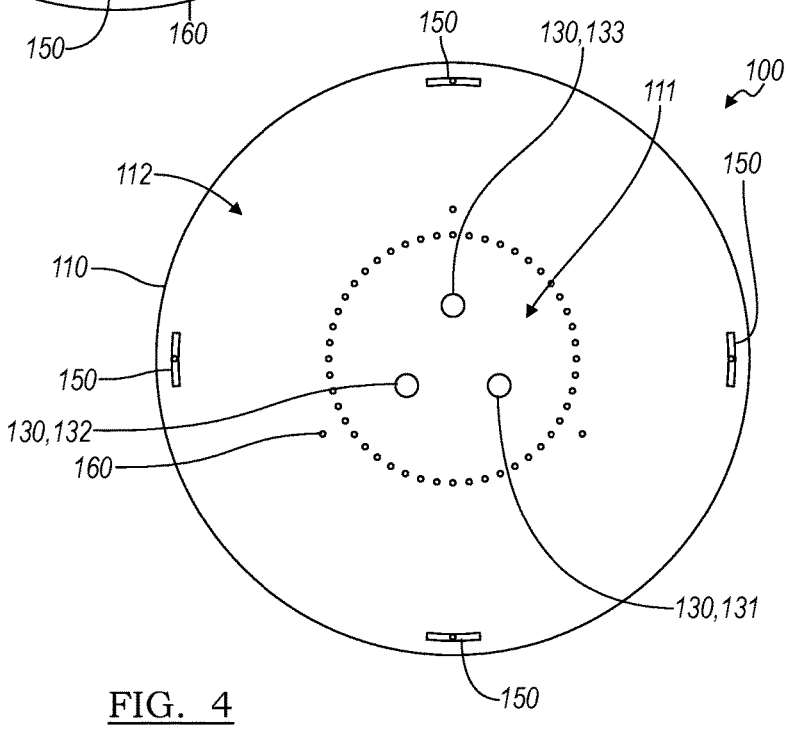
FIG. 4 is a schematic representation of one variation of the showerhead.
Figure 5:
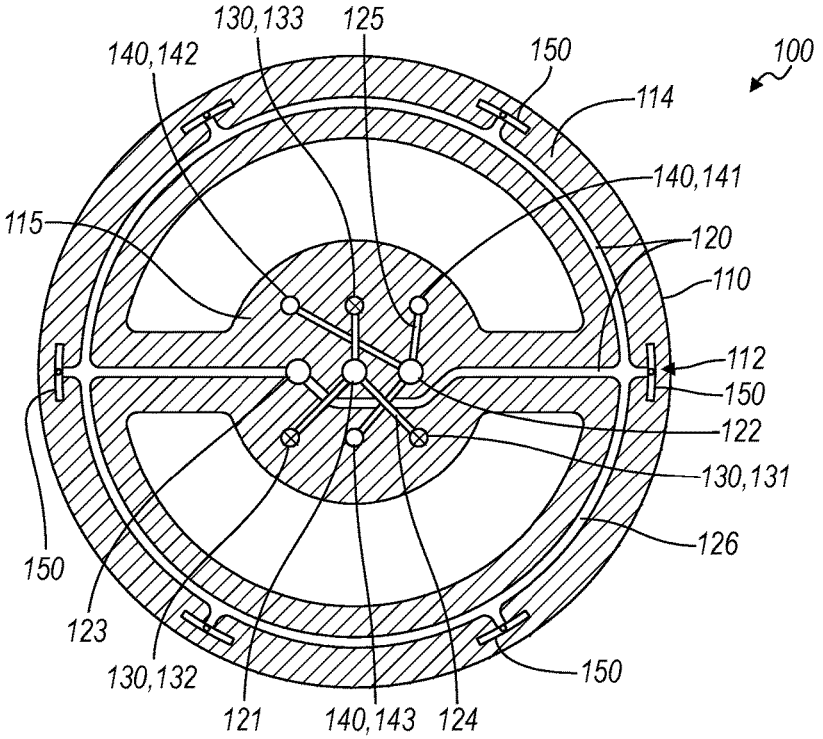
FIG. 5 is a schematic representation of one variation of the showerhead.
Figure 6:
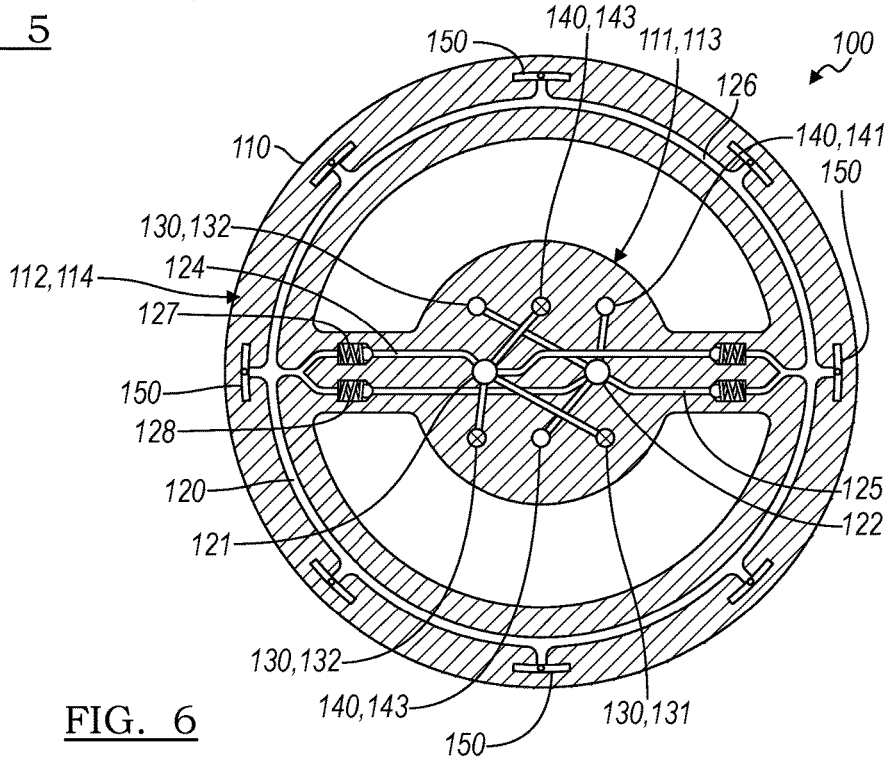
FIG. 6 is a schematic representation of one variation of the showerhead.
Figure 9:
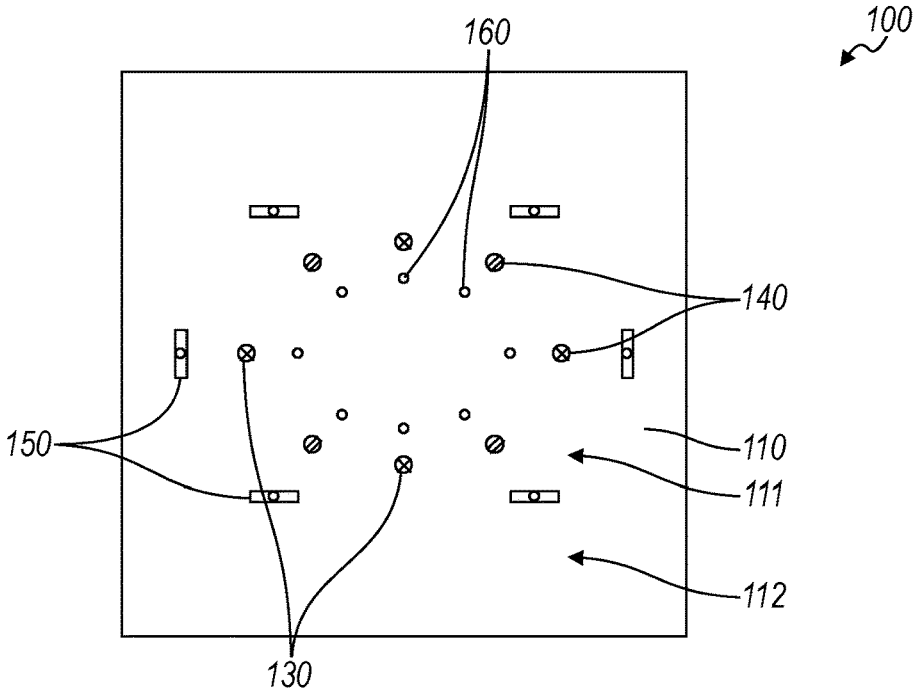
FIG. 9 is a schematic representation of one variation of the showerhead.
Figure 10:
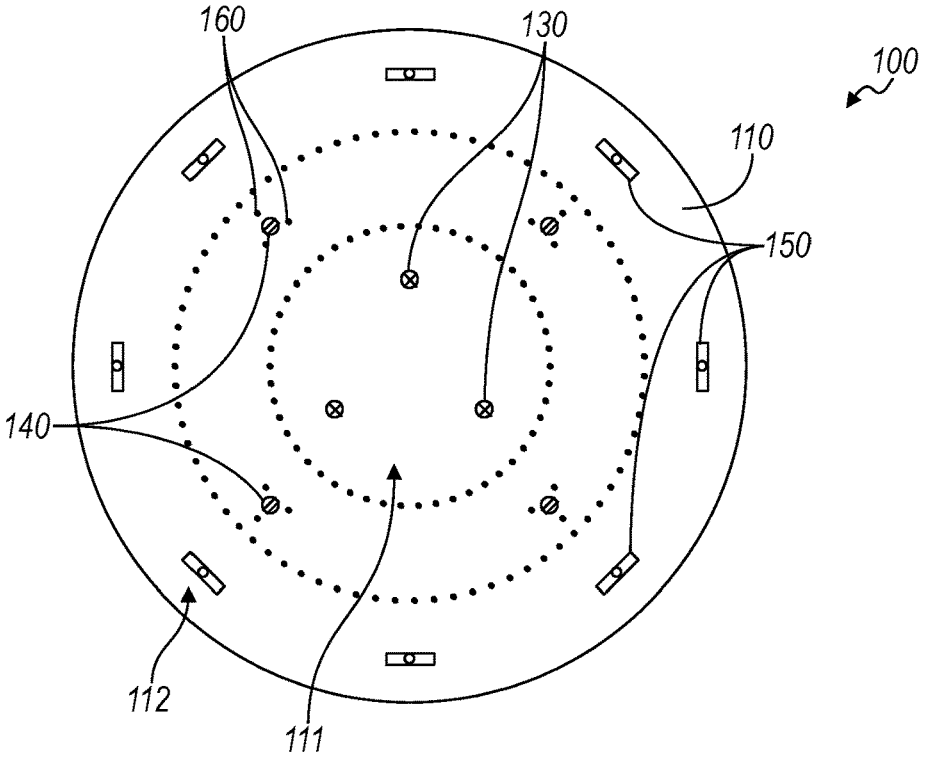
FIG. 10 is a schematic representation of one variation of the showerhead.

In one implementation, the body 110 includes: a first member 113 that defines the first region 111, a first channel 124, and an inlet that communicates fluid to the first channel 124; and a second member 114 extending from the first member 113 that defines the second region and a second channel 125 fluidly coupled to the first channel 124. For example, the first member 113 can define a linear member, and the second member 114 can define an annular member, wherein the linear member extends from a first lateral side of the annular member, across a radial center of the annular member 115, to a second lateral side of the annular member opposite the first lateral side, as shown in FIGS. 3, 5, and 6. Alternatively, the body 110 can define a toroidal member within a central opening or a disc-shaped member that is solid across its center, as shown in FIGS. 4, 9, and 10. Yet alternatively, the body 110 can alternatively define a square or rectilinear profile (e.g., as shown in FIG. 9) or any other suitable shape or geometry.

In one variation, the showerhead 100 includes a set of hollow cone nozzles 130 and a set of full cone nozzles 140 that are independently operable and a set of flat fan nozzles 150. In one implementation of this variation, the fluid circuit 120, defined by the body 110, includes three distinct fluid sections. For example, the dorsal side of the body 110 can define a first inlet port 121, a second inlet port 122, and a third inlet port 123. The fluid circuit 120 can include: a first channel 124 extending from the first inlet port 121 to the set of hollow cone nozzles 130; a second channel 125 extending from the second inlet port 122 to the set of full cone nozzles 140; and a third channel 126 extending from the third inlet port 123 to the set of flat fan nozzles 150, as shown in FIG. 5. In this example, a valve in an adjacent showerhead mount or wall-mounted control system selectively communicates fluid into the first inlet port 121 and into the second inlet port 122 while fluid flow to the third inlet port 123 persists during operation. Alternatively, the showerhead 100 can include a valve coupled to or arranged within the body 110 above the first and second inlets, and the user can manipulate the valve manually to select between the first and second channels and thereby between the set of hollow cone nozzles 130 and the set of full cone nozzles 140. Thus, the third channel 126 can remain open independently of the first and second channels during operation, and fluid can be selectively distributed to the first and second channels to selectively discharge hollow conical sprays and full conical sprays, respectively, from the showerhead 100.

Figure 2:
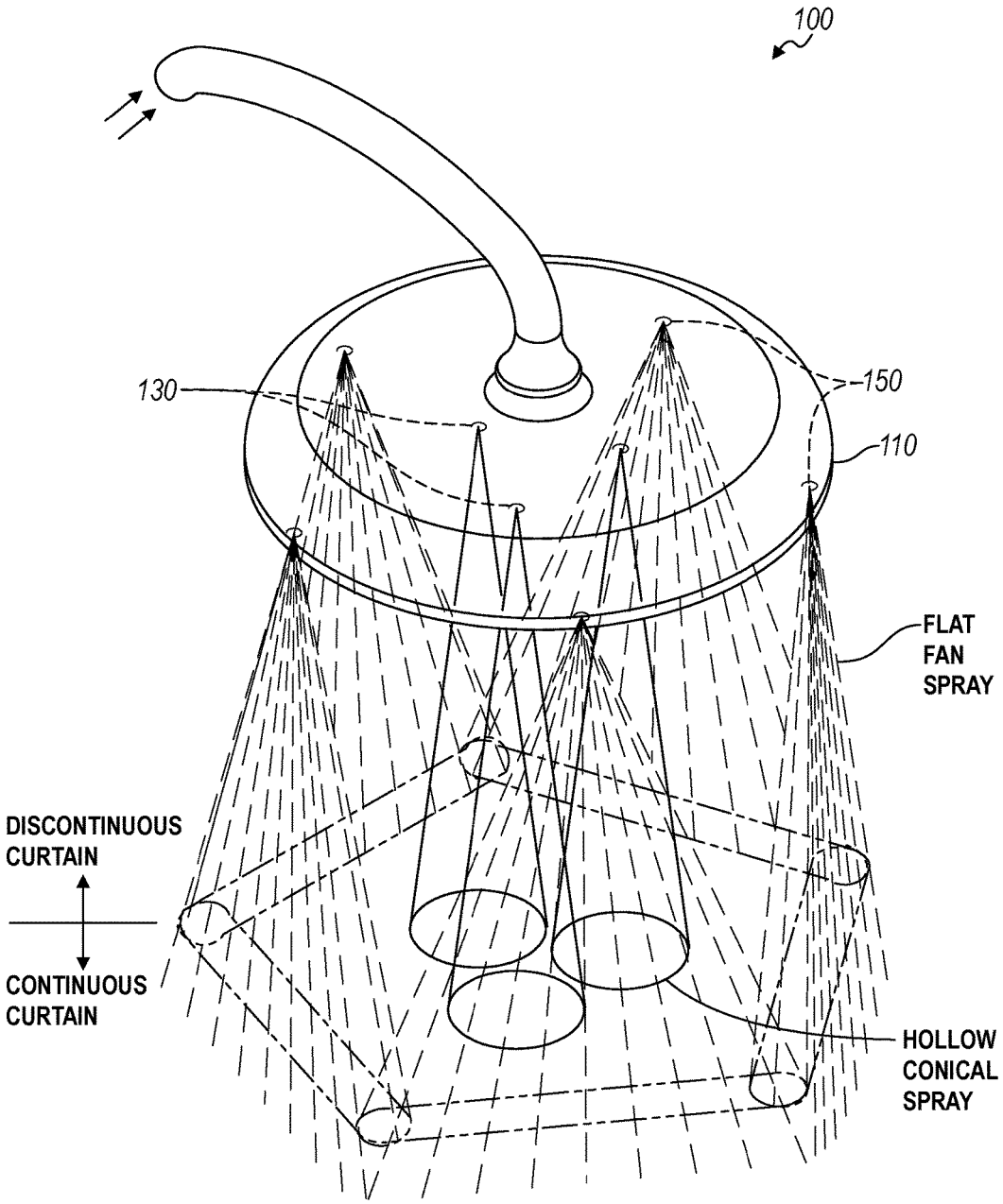
FIG. 2 is a schematic representation of one variation of the showerhead.

In another implementation of the foregoing variation, the dorsal side of the body 110 includes a first inlet 121 and a second inlet 122; and the fluid circuit 120 includes: a first channel 124 extending from the first inlet 121 to the set of hollow cone nozzles 130; a second channel 125 extending from the second inlet 122 to the set of full cone nozzles 140; and a third channel 126 fluidly coupled to the set of flat fan nozzles 150, fluidly coupled to the first channel 124, and fluidly coupled to the second channel 125, as shown in FIG. 6. In this implementation, the fluid circuit 120 can also include: a first check valve 127 interposed between the first channel 124 and the third channel 126; and a second check valve 128 interposed between the second channel 125 and the third channel 126, as shown in FIG. 6. For example, in the implementation described above in which the body 110 includes an annular member and a linear member extending across the center of the annular member 115 and supporting the (right and left) sides of the annular member, the first channel 124 can include: a first conduit extending from the first inlet 121 through the right side of the elongated member, past one or more hollow cone nozzles, and toward the right side of the annular member; and a second conduit extending from the first inlet 121 through the left side of the elongated member, past one or more hollow cone nozzles, and toward the left side of the annular member. In this example, the third annular member can define a toroidal conduit revolved fully around and bounded by the annular member and fluidly coupled to the flat fan nozzles. The fluid circuit 120 can include a first check valve 127 arranged between the first conduit and the right side of the toroidal conduit and a second check valve 128 arranged between the second conduit and the left side of the toroidal conduit, such that fluid entering the first inlet 121 flows through the first and second check valves, into the toroidal conduit, and through the flat fan nozzles. Furthermore, in this example, the fluid circuit 120 can similarly include a third check valve between the second channel 125 and the right side of the third channel 126 and a fourth check valve between the second channel 125 and the left side of the third channel 126, such that fluid entering the second inlet 122 flows through the third and fourth check valves, into the toroidal conduit, and through the flat fan nozzles, as shown in FIG. 6. However, the first and second check valves can prevent fluid flowing from the second channel 125 into the third channel 126 from flowing back into the first channel 124 and the third and fourth check valves can prevent fluid flowing from the first channel 124 into the third channel 126 from back-flowing into the second channel 125. Therefore, as in this example, the fluid circuit 120 can selectively distribute fluid entering the first and second inlets to either the set of hollow cone nozzles 130 and the flat fan nozzle or to the full cone nozzles and the flat fan nozzles, respectively. In this implementation, the body 110 can, thus, define two inlets and corresponding channels fluidly coupled to select nozzles such that the showerhead 100 can discharge hollow conical sprays (via the hollow cone nozzles and first channel 124) or a series of full conical sprays (via the full cone nozzles and the second channel 125) while maintaining a peripheral curtain of flat fan sprays (via the flat fan nozzles and the third channel 126) around the conical sprays, as shown in FIG. 2.

Alternatively, the body 110 can define a single inlet, and the fluid circuit 120 can include a manifold that distributes fluid from the inlet to each nozzle in the showerhead 100, such as to hollow cone nozzles and to full cone nozzles simultaneously. However, the body 110 can define any other number of inlets fluidly coupled to one or more hollow cone nozzles, full cone nozzles, flat fan nozzles, and/or jet orifices 160 in any other suitable way.

In the foregoing variation, the showerhead 100 can be fluidly coupled to a fluid supply via a valve (e.g., arranged within an adjacent showerhead mount) that selectively opens the fluid supply to the first and second channels. The user can, thus, manually operate the valve to selectively communicate fluid to the first channel 124 and to the second channel 125 to discharge a fine mist of fluid droplets during a wash cycle and to discharge a heavier mist of fluid droplets during a rinse cycle, respectively. Alternatively, the showerhead 100 can include an integrated valve, the body 110 can define a single inlet that communicates fluid into the valve. The valve can selectively distribute fluid to the first and second (and third) channels based on its position.

Alternatively, the showerhead 100 can include: a first set of nozzles that continuously discharge fluid droplet sprays while in operation; and a second set of nozzles that intermittently discharge fluid droplet sprays when selected by a user during operation of the showerhead 100. In one implementation, the showerhead 100 defines a first fluid circuit 171 extending from a first inlet port to the first set of nozzles and a second fluid circuit 181 extending from the second inlet port to the second set of nozzles. As described below, the showerhead 100 can be suspended from a showerhead mount (or a "bracket," shown in FIGS. 13, 14, 15A, and 15B) mounted to a wall within a shower stall. The bracket can include: an inlet line that fluidly couples to a water spigot extending out of a wall of the shower stall; a line splitter (e.g., a wye- or T-splitter) that directs flow from the water spigot into two separate supply lines; a first supply line 190 extending from the first outlet of the line splitter to the first inlet port of the showerhead 100; a second supply line 192 extending from the second outlet of the line splitter to the second inlet port of the showerhead 100; and a manually-operable extended-flow valve interposed between the second outlet of the line splitter and the second inlet port of the showerhead 100 along the second supply line 192, as shown in FIG. 17. When a user opens a valve in the wall of the shower stall, water can flow through the wall spigot, into the line splitter, and into the first inlet port via the first supply line 190 exclusively when the extended-flow valve is closed. When the user desires a greater sensation of water pressure reaching her body while showering under the showerhead 100, such as when rinsing soap from her hair, the user can manually open the extended-flow valve to permit water to flow through the second supply line 192, into the second inlet port, and through the second set of nozzles. In particular, when the extended flow valve is open, water can flow into the first fluid circuit 171 to be discharged as fluid droplet sprays from the first set of nozzles and into the second fluid circuit 181 to be discharged as fluid droplet sprays from the second set of nozzles, thereby yielding increased total flow rate through the showerhead 100 when the valve is open over periods of operation in which the valve is closed. The showerhead 100 can thus define a second, discrete fluid circuit connected on one end to an extended flow valve configured to selectively pass fluid under pressure to the second inlet port and terminating at an opposite end at one or more nozzles configured to intermittently discharge fluid droplet sprays when the valve is open.

Figure 15A:
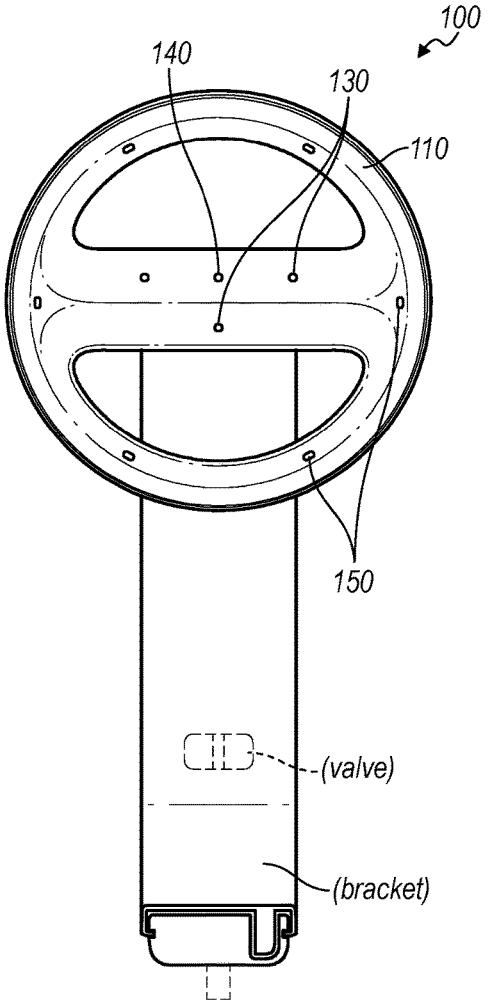
FIGS. 15A and 15B are schematic representations of one variation of the showerhead.
Figure 15B:
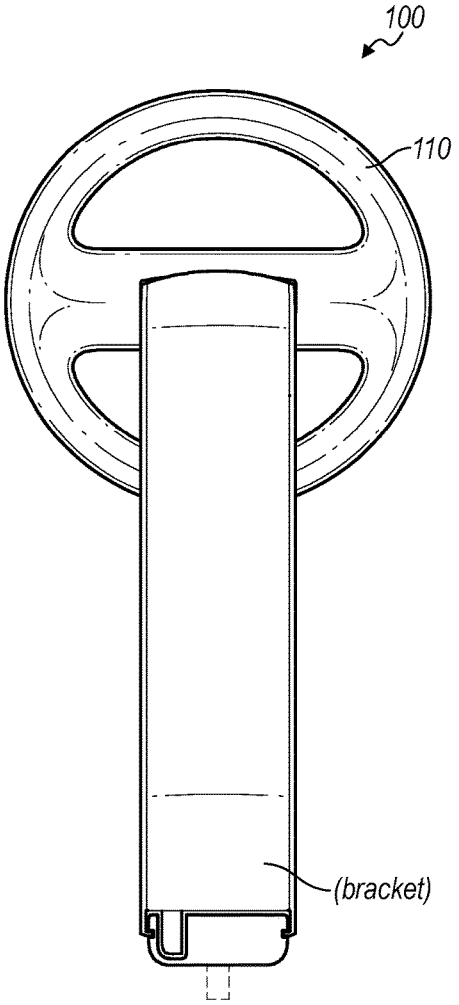

In one example shown in FIGS. 15A, 15B, and 16, the first set of nozzles includes: a first cluster of three hollow cone nozzles arranged in a triangular array about the center of the showerhead body 110 and configured to discharge fluid droplets in spray patterns approximating hollow cones extending outwardly from the ventral side of the body 110; and a second cluster of flat spray nozzles arranged in a radial pattern about the perimeter of the showerhead body 110 and configured to discharge fluid droplets in spray patterns approximating sheets fanning outwardly from the ventral side of the body 110. In this example, the second set of nozzles can include a single full cone nozzle arranged on the ventral side of the body 110 adjacent (e.g., centered within) the triangular array of hollow cone nozzles. Under common operating conditions, such as described below, the hollow cone and flat fan nozzles in the first set of nozzles can be configured to discharge relatively small fluid droplets (e.g., predominantly between 150 micrometers and 300 micrometers in width), and the full cone nozzle can be configured to discharge relatively larger fluid droplets (e.g., predominantly between 500 micrometers and 800 micrometers in width). When the extended flow valve in the bracket is closed, the flat fan and hollow cone nozzles can cooperate to discharge sprays of relatively small fluid droplets at a total flow rate of approximately 0.75 gallon per minute. However, when the extended flow valve in the bracket is opened, the full cone nozzle can discharge a spray of relatively larger fluid droplets and cooperate with the hollow cone and flat fan nozzles to achieve a total flow rate of approximately 1.0 gallon per minute through the showerhead 100.

4. Body Fabrication and Fluid Circuit

In the foregoing variation, the body 110 can define a thin wall between the first and second channels such that, when the first channel 124 is open (i.e., fluid is flowing into the first inlet port 121 and through the first channel 124) and the second fluid conduit is closed (i.e., volume flux through the second inlet port 122 is approximately null), heated fluid flowing through the first channel 124 transfers heat through the thin wall between the first and second channels, thereby heating fluid remaining in the second channel 125. Thus, when the second channel 125 is opened, such as during a rinse cycle near the end of a shower period, fluid initially discharged from the second channel 125 via the full cone nozzles is at a temperature substantially similar to that of fluid flowing through the first channel 124 immediately prior. Furthermore, the body 110 can include a thin-walled shell and/or be of a material characterized by substantially minimal thermal mass or high thermal conductivity such that, at the beginning of a shower period, the body 110 requires less time to warm to the temperature of fluid flowing through the showerhead 100.

The showerhead 100 can further include a shell surrounding and offset from (a portion of) the body 110. The shell can be of a material of relatively low thermal conductivity and can, thus, define a thermal break around the body 110 to limit heat transfer from the body 110 and to ambient via convection and/or radiation, which may otherwise reduce the temperature of the heated fluid passing through the body 110 during operation. For example, the shell can be offset from the body 110, and the void between the shell and the body 110 can be held at vacuum or filled with an insulator (e.g., a low-weight, expanding foam) to limit heat transfer from the body 110 into the shell.

The body 110 can be assembled from multiple discrete components that are injection molded, cast, stamped, spun, machined, extruded, and/or formed in any other way—such as in a polymer (e.g., nylon, polyoxymethylene), a metal (e.g., stainless steel, aluminum), or any other suitable material—and then assembled. In one implementation, the body 110 includes: a first section defining the ventral side of the body 110; and a second section defining a dorsal side of the body 110, installed over the first section, and cooperating with the first section to enclose the fluid circuit 120. In one example, the first section includes a fiber-filled composite section defining a set of outlet bores across its dorsal side and a series of open channels opposite its dorsal side, wherein each open channel routes across a subset of the outlet bores. In this example, the second section includes a cover plate defining a set of inlet bores and is ultrasonically welded over the open channels in the first section, thereby closing the open channels to form the fluid circuit 120. In this example, the inlet bores in the second section can be aligned with select open channels in the first section, such that fluid entering the inlet bores is distributed to appropriate outlet bores by select channels in the fluid circuit 120. Nozzles of various types can then be installed in select orientations in select outlet bores in the assembled body, such as by pressing, threading, or fusing (e.g., chemically bonding, ultrasonically welding) a nozzle into a corresponding outlet bore in the body 110. In this example, the first and second sections of the body 110 can alternatively be laser welded, chemically bonded (e.g., with a solvent cement), sealed and fastened (e.g., with a silicone sealant and a set of threaded fasteners), or assembled in any other way. In a similar example, the first section of the body 110 can define a set of outlet bores, as described above, and the second section of the body 110 can define a set of inlet bores and open channels. In this example, when the first section and the second section are assembled, the interior surface of the first section can close the open channels in the second section with the outlet bores terminating in corresponding open channels defined by the second section.

In another implementation, the body 110 defines an open internal volume, and the inlets and nozzles are fluidly coupled by sections of (rigid or flexible) tubing and union tees. In one example, the body 110 includes: a shell defining a dorsal side, a series of outlet bores across the dorsal side of the shell, and an internal volume terminating in an access window opposite the dorsal side of the shell; and a cover plate defines a set of inlet bores. In this example, discrete nozzles are installed (e.g., threaded) into the outlet bores in the shell, pass-through adapters (i.e., inlets) are installed in the inlet bores in the cover plate, and sections of tubing and union tees are connected between the pass-through adapters and select nozzles to form the fluid circuit 120. The cover plate is then installed over the window in the shell to close the fluid circuit 120 within the internal volume. In this example, the cover plate can be welded to the shell, bonded (e.g., with an adhesive) to the shell, fastened to the shell (e.g., with one or more threaded fasteners), or coupled to the shell in any other suitable way. In this example, each nozzle and pass-through adapter can include a nipple extending into the internal volume of the shell, and each set of hollow cone nozzles 130, full cone nozzles, and flat fan nozzles can be connected in series by sections of heat-resistant tubing and union tees. The showerhead 100 can also include discrete in-line check valves terminating in a nipple on each end and installed between select sections of tubing (e.g., between select tubing sections teed from a hollow cone nozzle or from a full cone nozzle). Alternatively, the check valves can be integrated into union tees. Yet alternatively, the body 110 can include a set of discrete manifolds fluidly coupled to corresponding pass-through adapters or integrated into the pass-through adapters; each manifold can include multiple nipples, and tubing sections arranged between a manifold and a set of nozzles can communicate fluid from the manifold to the nozzles in parallel.

In the foregoing implementations, the body 110 can also include one or more features or elements in the fluid circuit 120 to regulate volume flow rate through various nozzles in the showerhead 100. In particular, the droplet size, discharge velocity, and spray angles of hollow conical, full conical, and flat fan sprays discharged from hollow cone nozzles, full cone nozzles, and flat fan nozzles may be affected by volume flow rate through the nozzles, which may be a function of fluid pressure at the inlets of these nozzles. The body 110 can, therefore, include one or more pressure regulators or restriction plates within the fluid circuit 120 to reduce fluid pressures communicated from the inlets to and to reduce volume flow rate through particular nozzles to achieve a target range of droplet sizes, discharge velocities, and spray angles for sprays discharged from these nozzles. For example, the body 110 can define one or more restriction plates (e.g., orifice plates, regions of reduced cross-sectional area) along the fluid circuit 120, such as between the first channel 124 and the third channel 126 or between the third inlet port 123 and the third channel 126 to reduce fluid pressure in the third channel 126, to reduce volume flow rate through the set of flat fan nozzles 150, and thus to reduce droplet size and/or discharge velocity from the flat fan nozzles.

The first, second, and third channels in the fluid circuit 120 in the body 110 can also be of particular constant or varying cross-sections, lengths, and/or surface finishes, etc. to achieve targeted head losses (i.e., total fluid pressures losses) from a corresponding inlet to a corresponding nozzle to achieve target volume flow rates through the nozzles, such as given an supplied fluid pressure within a common water supply pressure range of 45 psi to 60 psi. For example, in the foregoing implementation in which the inlets are connected to the nozzles by discrete tubing sections, each tubing section can be cut or formed (e.g., injection-molded, extruded) in a rigid material (e.g., nylon) or a flexible material (e.g., silicone) and can define a constant or varying cross-section over a controlled length to achieve a target head loss along its length for water in an operating temperature range of 100° F. to 120° F. passing through the tubing section. In this example, the body 110 can include shorter, wider tubing sections that connect the first inlet port 121 to the first channel 124 to achieve a relatively small pressure drop from the inlets to the hollow cone nozzles, thereby yielding relatively smaller droplets from the hollow cone nozzles, and the body 110 can include longer, narrow tubing sections that connect the third inlet port 123 to the third channel 126 to achieve a relatively greater pressure drop from the inlets to the flat fan nozzles, thereby yielding relatively larger droplets from the flat fan nozzles, as described below. Alternatively, as in the preceding implementation, the body 110 can similarly define integrated channels of constant or varying cross-sections and of specific lengths between corresponding nozzles and corresponding nozzles to achieve such controlled head losses therebetween.

The showerhead 100 can also include a pressure regulator ahead of the inlets and configured to regulate an unregulated inlet pressure to a target operating pressure within the fluid circuit 120. For example, the showerhead 100 can include a diaphragm-type pressure regulator arranged at one or more inlets and configured to reduce residential or commercial water supplies ranging from 50 pounds per square inch (or "psi") to 100 psi down to a regulated 20 psi. In another example, the showerhead 100 can include a restriction plate or similar orifice ahead of each inlet (e.g., inlets 121, 122, and 133) that cooperate to restrict volume flow rate through the body to a particular target range of nozzle exit pressures, such as between 20 psi and 40 psi, thereby yielding a net volume flow rate between 0.6 gpm and 0.9 gpm when connected to a residential water line supplying water at a pressures between 35 psi and 80 psi.

Alternatively, fluid circuit 120 can define channels or channel sections of substantially similar cross-sections, and each nozzle in the sets of hollow cone, full cone, and/or flat fan nozzles can define a particular geometry (e.g., an effective orifice area, a total length, inlet and outlet lengths and angles, etc.) to achieve an outlet pressure within a target range given a fluid supply to the inlet(s) within a particular range of fluid pressures. The sets of nozzles can cooperate to achieve a target range of volume flow rates through the showerhead 100, such as a total volume flow rate between 0.6 gpm and 0.9 gpm. For example, when the first fluid inlet 121 and the third fluid inlet 123 are open and the second fluid inlet 122 is closed, the set of hollow cone nozzles and flat fan nozzles can cooperate to discharge fluid droplets at a total volume flow rate between 0.6 gpm and 0.75 gpm given a common inlet pressure range. In this example, when the second fluid inlet 122 and the third fluid inlet 123 are open and the first fluid inlet 121 is closed, the set of full cone nozzles and flat fan nozzles can cooperate to discharge fluid droplets at a total volume flow rate between 0.75 gpm and 0.9 gpm for the same range of inlet pressures.

Yet alternatively, each inlet in the showerhead 100 can define a particular effective orifice area through which fluid (e.g., water) can flow, wherein the individual or combined effective orifice areas of the inlets 121, 122, and/or 123 restrict volume flow rate through the showerhead 100 to a target volume flow rate between 0.6 gpm and 0.9 gpm when connected to a residential water line supplying fluid at a pressure between 35 psi and 80 psi.

The fluid circuit 120 can thus define features and/or geometries that achieve both a minimum target volume flow rate range through the nozzles and a fluid droplet cloud exhibiting average cross-sectional temperatures at distances from the body 110 approaching asymptotes of maximum average cross-sectional temperature values at corresponding distances from a showerhead for a water supply of a given temperature, such as shown in FIG. 12A. In particular, the showerhead 100 can define various features and/or geometries within the fluid circuit 120 that limit volume flow rate through the nozzles to a low, narrow volume flow rate range while also discharging a cloud of fluid droplets of sufficient size, density, and velocity to achieve temperatures at various distances from the body substantially similar to (e.g., within 5% of) temperatures of streams or clouds discharged by a showerhead operating at a substantially greater (e.g., 2×) volume flow rate. For example, the showerhead 100 can achieve water savings as high as 72% over classical showerheads while still achieving average discharged cloud temperatures at various distances from the showerhead 100 that approach average temperatures of streams discharged by and at similar distances from such classical showerheads with water savings less than 72%, as shown in FIG. 12B. However, the body 110 can define integrated or discrete channels or any other geometry or material between the inlets and the nozzles and can include any other feature or element to control volume flow rates through and/or fluid pressures reaching the hollow cone, full cone, and/or flat fan nozzles.

As described above, the nozzles can define discrete structures and can be installed in the body 110. Alternatively, the nozzles can be integrated into the shell, and the nozzles and (a section of) the body 110 can define a unitary (i.e., singular) structure. For example, the shells and nozzles can be injection-molded in-unit in a single material. In another example, the shell and nozzles can be injection-molded in-unit in a double-shot injection mold by first injecting a low-wear polymer (e.g., polyphenylene sulfide) into the mold in multiple discrete locations to form the nozzles and then injecting a color-stable polymer (e.g., fiber-filled nylon) into the mold to form the shell. In yet another example, the shell can be stamped in stainless steel, punched to define nozzle receptacles, finished (e.g., polished, brushed), and inserted into an injection mold, and a polymer can be injected into the mold to mold nozzles directly into each nozzle receptacle in the stainless steel shell. However, the nozzles can be installed or integrated into the body 110 in any other suitable way.

5. Turbulence Mitigation

In one variation shown in FIGS. 16 and 18, the showerhead 100 defines a fluid circuit that distributes fluid from an inlet port 121 on the dorsal side of the body 110 to various nozzles configured to discharge fluid droplet sprays from the ventral side of the body 110. In this variation, the fluid circuit 171 can include: a common inlet port; a set of nozzles; a manifold 172 extending from the common inlet port toward each nozzle; and a set of discrete flow paths extending from the manifold 172 and terminating at the inlet of one corresponding nozzle; all of which cooperate to achieve fully-developed flow conditions at the inlet of each nozzle.

As described below, the showerhead 100 can include a set of nozzles that discharge fine sprays or "mists" of fluid (e.g., water). For example, the showerhead 100 can include one or more flat fan nozzles that discharge fluid droplets predominantly between 300 micrometers and 500 micrometers in width, one or more hollow cone nozzles that discharge fluid droplets predominantly between 150 micrometers and 300 micrometers in width, and one or more full cone nozzles that discharge fluid droplets exceeding 500 micrometers in width. Flow rate through a nozzle, size of droplets discharged from the nozzle, and the spray angle of fluid discharged from the nozzle can be a function of pressure and flow conditions at the inlet of the nozzle (in addition to fluid temperature and viscosity, etc.). In particular, pressure drop through the nozzle, flow rate through the nozzle, size of discharged fluid droplets, and spray angle can remain substantially consistent while fluid reaching the inlet of the nozzle remains laminar and/or fully-developed (even with slow-time scale changes in pressure at the inlet port, such as due to pressure variations in residential water supply, and changes in water temperature as a water heater is drained). However, if fluid reaches the inlet of the nozzle in a turbulent condition in which the net direction of fluid flow is not coaxial with the nozzle, such inconsistent, variable-pressure flow of fluid into the nozzle can produce sputtering in the spray discharged from the nozzle, thereby yielding inconsistent flow rate, droplet size, and spray angle. Brief instances of increased flow rate (e.g., from 1 gallon per minute to 2 gallons per minute) and increased droplet sizes (e.g., from 250 micrometers to 500 micrometers) and/or droplet spray pattern (e.g., increasing spray angle and decreased consistency in droplet size) resulting from turbulent flow into the nozzle can produce stinging sensations and discomfort for a user when these droplets reach the user's skin. Similarly, brief instances in decreased flow rate (e.g., from 1 gallon per minute to 0.5 gallon per minute) and decreased spray angle resulting from turbulent flow into the nozzle can increase a distance from the showerhead 100 at which sprays from flat fan nozzles along the periphery of the showerhead 100 coalesce to from a curtain around the user, as described below, thereby allowing cool air outside of the curtain to reach the user and further causing the user discomfort while showering. Furthermore, fluttering through the nozzle can cause the nozzle to discharge smaller droplets that exchange heat to ambient air at an increased rate, thereby resulting in an uncontrolled sensation of a colder shower and decreasing the user's comfort while showering.

Furthermore, variations in backpressure between the inlet port and the nozzle resulting from local turbulence behind this nozzle can be communicated to the inlets of other nozzles in the showerhead 100, thereby yielding similar variations in flow rates, droplet sizes, and spray angles of these other nozzles. For example, disturbances in flow at one nozzle can trigger turbulence elsewhere within the showerhead 100 such as near inlets of other nozzles. While a turbulent flow condition exists within the showerhead 100, pressure at the inlets of the nozzles can oscillate, thus yielding oscillating flow rates, droplet sizes, and spray angle conditions across these nozzles.

Therefore, the showerhead 100 can include an inlet port, a manifold 172, and one discrete flow path per nozzle—rather than a single common cavity between the inlet port and the nozzles—that cooperate to distribute fluid laterally from the inlet port toward each nozzle and then downward into each nozzle with fluid achieving a fully developed (and laminar) flow condition by the inlet of each nozzle under common operating conditions, such as for water flowing into the showerhead 100 within an operating temperature range between 90° F. and 120° F. and within an operating pressure range between 30 and 55 psi. In particular, the inlet port functions to receive fluid entering the showerhead 100 and to communicate this fluid downward into the manifold 172, and the manifold 172 distributes this fluid laterally through the body 110 of the showerhead 100 to locations near each nozzle. Each discrete flow path intersects the manifold 172, communicates fluid laterally toward a corresponding nozzle and then substantially vertically downward into the inlet of the corresponding nozzle, and terminates at the inlet of the corresponding nozzle.

As shown in FIGS. 16 and 18, each flow path includes: a branch 173 extending laterally from the manifold 172; and an entry transition 174 extending substantially vertically from the end of the branch 173—opposite the manifold 172—into the inlet of one nozzle. Both the branch 173 and the entry transition 174 can define relatively small cross-sectional areas that promote laminar flow toward the corresponding nozzle. The entry transition 174 can also form a curvilinear sweep extending from tangent its corresponding branch 173 to tangent the axis of its corresponding nozzle (i.e., tangent to the inlet of the corresponding nozzle) in order to define a smooth transition from lateral flow from the manifold 172 to vertical flow toward the nozzle and to reduce nucleation sites and cavitation along this directional transition into the nozzle.

Each flow path can also terminate at a corresponding nozzle. By segregating flow from a common inlet port and common manifold 172 into a single, relatively long intake runner that terminates at one particular nozzle, a flow path can contain a volume of fluid that buffers fluid at the inlet of the particular nozzle from variations in pressure within the manifold 172 occurring during operation, thereby shielding the nozzle from disturbances within the manifold 172 (and inlet port and other nozzles) that may trigger turbulence near the inlet of the particular nozzle. For example, a volume of fluid contained within and moving through a flow path at an instant in time can exhibit inertia that resists changes in flow rate in the presence of disturbances within the manifold 172 and elsewhere within the fluid circuit 171, such as due to variations in flow rate at a municipal water supplier or due to intermittent use of other toilets, showers, or faucets located within the same building as the showerhead 100.

Therefore, the showerhead 100 can include multiple flow paths extending from a common manifold 172 toward a corresponding nozzle and defining a cross-section and sweep geometry that induces laminar flow, suppresses nucleation sites, and discourages turbulence and cavitation. In particular, the branch 173 of each flow path can traverse a length greater than a minimum entrance length within which laminar flow develops fully downstream of the manifold 172; and the entry transition 174 of each flow path can traverse a length greater than a minimum vertical flow length over which laminar flow develops fully before entering a corresponding nozzle.

In this variation, the manifold 172 functions to distribute fluid from the inlet port to each flow path. In one example shown in FIG. 13, the showerhead 100 defines a short cylindrical section, such as approximately 1.5 inches in height and approximately 10 inches in diameter (i.e., such that the width of the showerhead 100 is more than four times its depth). In this example, the showerhead 100 includes: a cluster of three hollow cone nozzles arranged in a triangular array about the axial center of the showerhead body 110; and a cluster of six flat fan nozzles arranged along the perimeter of the body 110, such as at 30°, 90°, 150°, 210°, 270°, and 330° radial positions. In this example, the body 110 can also define open regions between the clusters of hollow cone and flat fan nozzles in order to form handles on the body 110 for manually articulating the showerhead 100 on a bracket, mount, or spigot; and the manifold 172 can define a sinuous path that sweeps or "snakes" laterally around the cluster of hollow cone nozzles near the center of the body 110 toward the cluster of flat fan nozzles along the perimeter of the body 110.

In one variation shown in FIGS. 16 and 17, the showerhead 100 defines a second fluid circuit 181 including: a second inlet port adjacent the first inlet port and configured to receive fluid under pressure; a second nozzle defining a second inlet port facing the dorsal side of the body 110 of the showerhead 100 and a second outlet facing the dorsal side of the body 110; and a second flow path that distributes fluid—in a fully-developed and substantially coaxial condition—into the second nozzle. Like flow paths in the first fluid circuit 171 described above, the second flow path can include: a second entry transition 184 substantially coaxial with the second nozzle, extending substantially vertically from the second inlet port of the second nozzle toward the dorsal side of the body 110, and defining a second length greater than the minimum vertical flow length; and a second branch 183 fluidly coupled to the second inlet port, extending laterally, terminating at the second entry transition 184, and defining a second length greater than the minimum entrance length. In this variation, the second flow path in the second fluid circuit 181 can define a geometry similar to that of a flow path in the first fluid circuit 171 in order to promote laminar flow of fluid upon entry into the inlet of the second nozzle. As described above, the second fluid circuit 181 can include a single nozzle, such as a full cone nozzle, and the second flow path can extend directly from the second inlet port to the second nozzle. Alternatively, the second fluid circuit 181 can include: a second set of nozzles—such as multiple full cone nozzles intermingled with a set of hollow cone nozzles in the first fluid circuit 171, as shown in FIG. 5; a second set of flow paths, each terminating in one nozzle in the second set of nozzles; and a second manifold that distributes fluid to the second set of flow paths, as in the first fluid circuit 171 described above.

However, the showerhead 100 can include any other number of discrete fluid circuits extending from one inlet port to one or more discrete nozzles.

6. Fluid Circuit Insert

In one variation shown in FIGS. 16 and 18, the showerhead 100 includes: a fluid circuit insert 170 that defines a fluid circuit between a common inlet port and outlets of multiple nozzles; and a separate body 110 that houses and supports the fluid circuit insert 170. In this variation, the body 110 defines an aesthetic cover installed over a fluid circuit insert 170 that defines one or more discrete fluid circuits.

In one implementation shown in FIG. 18, the fluid circuit insert 170 includes a polymer structure defining a first inlet port, a first manifold 172, a first set of branches, and a first set of entry transitions; and each nozzle defines a discrete metallic insert mechanically coupled to (e.g., installed into) the polymer body 110. For example, the fluid circuit insert 170 can include a rigid upper section 170A and a lower section 170B both injection-molded in polycarbonate, nylon, or other substantially water-stable polymer. In this example, the lower section 170B of the polymer structure can define a set of bores, wherein each bore terminates in a shelf around a through-hole coaxial with a corresponding entry transition 174 defined by the upper and lower sections of the fluid circuit insert 170 when assembled. As shown in FIG. 18, the fluid circuit insert 170 can also include a seal 179—such as silicone, ethylene propylene diene terpolymer, or fluoropolymer O-ring—arranged in a groove on the shelf of each bore; and each nozzle can define a flange configured to mate with a corresponding seal 179 when installed in a corresponding bore in the lower section 170B of the fluid circuit insert 170. In this example, the upper can also include a tab extending downward over each bore in the lower; when the upper section 170A of the fluid circuit insert 170 is installed over the lower section 170B of the fluid circuit insert 170, each tab can contact an adjacent nozzle near its inlet and depress the adjacent nozzle downward onto its seal 179 to seat the nozzle to the fluid circuit insert 170, as shown in FIG. 18. The upper section 170A of the fluid circuit insert 170 can similarly define a bore and a shoulder or stem extending upward to form an inlet port when the upper and lower sections of the fluid circuit insert 170 are assembled.

In the foregoing example, when assembled, the upper and lower sections of the fluid circuit 171 can define one or more discrete fluid circuits. For example, the upper and lower sections of the fluid circuit insert 170 can be heat-staked, hot-plate welded, ultrasonically welded, bonded with an adhesive, or joined in any other way to form a continuous seal around each fluid circuit on the plane between the upper and lower sections of the fluid circuit insert 170 and to constrain each nozzle in-line with its flow path.

Once the fluid circuit insert 170 is assembled and sealed, the body 110 can be installed over the fluid circuit insert 170. For example, the body 110 defines a clamshell structure including upper and lower halves of injection molded polymer, die cast aluminum, or stamped or spun metal, etc. The upper half 110A of the body 110 can define inlet orifices configured to receive a shoulder or stem—defining an inlet port—extending upward from the upper section 170A of the fluid circuit insert 170. Similarly, the lower section 170B of the body 110 can define a set of orifices, each of which align with the outlet of a corresponding nozzle when the body 110 is assembled over the fluid circuit insert 170. In this example, the upper and lower halves of the body 110 can be mechanically fastened together (e.g., with a set of machine screws), snapped together via a set of integral snap features, bonded together with an adhesive, welded together, or otherwise assembled over the fluid circuit insert 170. When assembled, the inlet ports extending from the top of the fluid circuit insert 170 can pass through corresponding orifices in the body 110 to meet supply lines in an adjacent bracket. Each nozzle can be recessed behind and coaxial with a corresponding orifice in the lower section 170B of the body 110, or the outlet of each nozzle can extend up to or (slightly) through a corresponding orifice in the lower section 170B of the body 110. The body 110 can also include support tabs, anchors, stanchions, standoffs, or other alignment features that function to constrain and support the fluid circuit insert 170 within the body 110 when the upper and lower halves of the body 110 are assembled around the fluid circuit insert 170. For example, the fluid circuit insert 170 can be: mechanically fastened or bonded to a stanchion or standoff on one or both halves of the body 110; located within the body 110 by one or more alignment features and potted within the body 110; or pinched between standoffs on each half of the body 110 when the halves are assembled over the fluid circuit insert 170.

However, the body 110 and fluid circuit can define any other form and any other number of fluid circuits.

7. Bracket Connection

Figure 13:
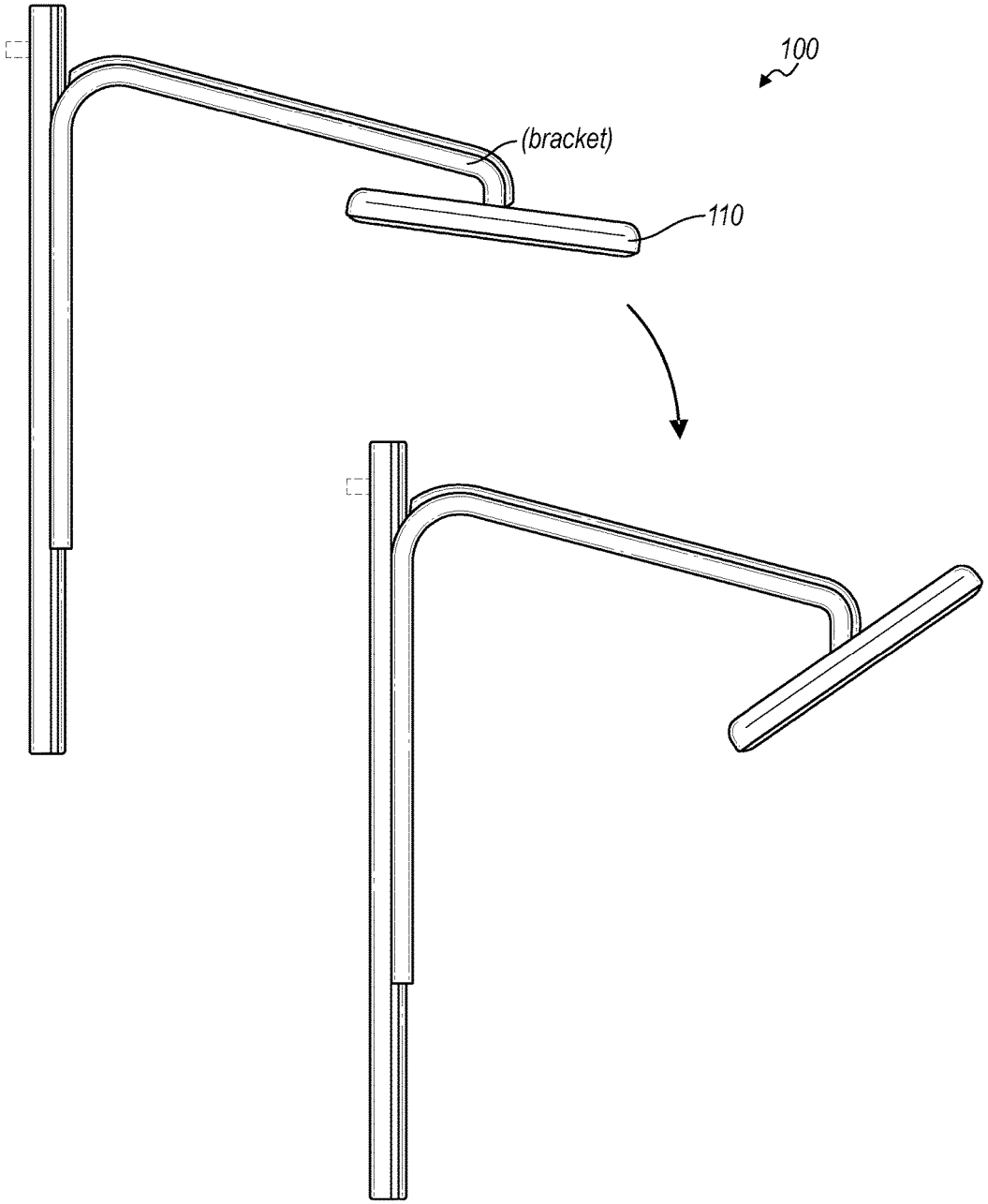
FIG. 13 is a flowchart representation of one variation of the showerhead.

The body 110 of the showerhead 100 can also be mounted to and suspended over a shower stall by a bracket. In one implementation, the body 110 defines a hinge extending from its dorsal side and pivotably coupled to the bracket. For example, the hinge can permit the body 110 to pivot—along a horizontal axis—up to 30° toward the bracket and up to 45° away from the bracket, as shown in FIG. 13. The hinge can include a clutch or other friction element that preserves an angular position of the showerhead 100 relative to the bracket.

As described above, the bracket can include a supply line that meets an inlet port on the dorsal side of the showerhead 100. To accommodate changes in the angular position of the showerhead 100 on the bracket, the supply line can be flexible, such as a flexible silicone tubing, poly(vinyl chloride) tubing, or tubing of terpolymer of tetrafluoroethylene, hexafluoropropylene and vinylidene fluoride. The flexible supply line can be heat shrunk, compression fit, glued, fixed with a compression band, or otherwise connected to the inlet port.

Alternatively, the showerhead 100 can further include an angle fitting interposed between the first inlet port and the flexible supply line, and the flexible supply line can be coupled to angle fitting as described above. In this implementation, the showerhead 100 can pivot on the bracket about an axis substantially parallel to an axis of the flexible line where the flexible line meets the angle fitting such that tension on the end of the flexible line is limited as the showerhead 100 is manually reoriented on the bracket by users over time. In the variation described above in which the showerhead 100 includes multiple discrete fluid circuits, the bracket can include multiple supply lines, each of which similarly couples to a corresponding inlet port at the dorsal side of the body 110.

Alternatively, the showerhead 100 can be rigidly mounted to the bracket or coupled to the bracket in any other way.

8. Hollow Cone Nozzles

The showerhead 100 includes a set of hollow cone nozzles 130 distributed within the first region 111 of the body 110 and fluidly coupled to the fluid circuit 120. Generally, each hollow cone nozzle in the set of hollow cone nozzles 130 discharges fluid droplets in spray patterns approximating hollow cones extending outwardly from the first region 111 of the body 110. As described above, the set of full cone nozzles 140 can discharge fluid droplets in discrete fine mist sprays, such as fluid droplets between 150 micrometers and 350 micrometers in width. The showerhead 100 can also include a set of full cone nozzles 140, flat fan nozzles, and/or jet orifices 160 that discharge larger fluid droplets, such as between 350 micrometers and 500 micrometers in width, between 350 micrometers and 800 micrometers in width, and between 600 micrometers and 3000 micrometers in width, respectively.

In one implementation, each hollow cone nozzle includes an inlet, a core or swirl plate, and an outlet orifice, wherein a continuous stream of fluid passes into the inlet, through the swirl plate, and out of the outlet orifice as fluid droplets in a hollow cone pattern. A hollow cone nozzle in the set of hollow cone nozzles 130 can additionally or alternatively include a nebulizer fluidly coupled to an air inlet on the body 110, such as an inlet passing from the dorsal side of the body 110 to the hollow cone nozzle; in this implementation, fluid flowing through the hollow cone nozzle draws air through the air inlet, mixes with this air within the hollow cone nozzle, and exits the hollow cone nozzle as a mist of small fluid droplets. However, the hollow cone nozzles can be of any other geometry and can be any other nozzle type.

As described above, the hollow cone nozzles can be molded, cast, machined, printed, or otherwise formed in situ with the body 110 (e.g., with the first section of the body 110). Alternatively, the hollow cone nozzles can define discrete components installed into the body 110. For example, the body 110 can define a fiber-filled composite shell with threaded outlet bores, and the set of hollow cone nozzles 130 can include machined, threaded bronze nozzles (shown in FIGS. 11A and 11B) that are threaded into the threaded outlet bores of the body 110. Alternatively, the hollow cone nozzles can be cast, machined, injection molded, or formed in any other material (e.g., polyphenylene sulfide, aluminosilicate) and can be press-fit, bonded, or installed into the body 110 in any other way.

Figure 7A:
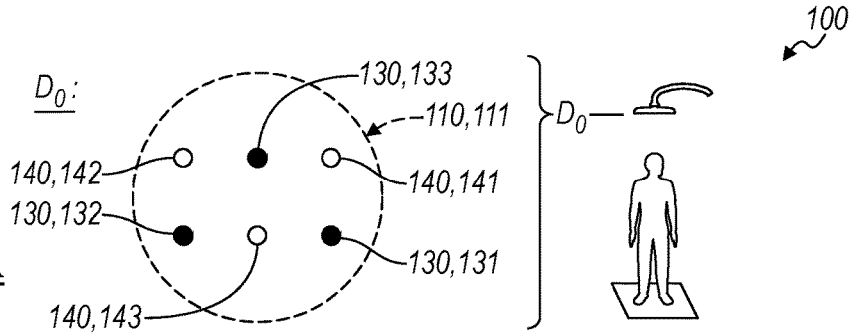
FIGS. 7A, 7B, 7C, and 7D are schematic representations of one variation of the showerhead.

The hollow cone nozzles can be distributed across the first region 111 of the body 110 to achieve a target spray profile at a target distance from the showerhead 100. In one implementation, the first set of nozzles is distributed across the first region 111 of the body 110 in a linear array. For example, the set of hollow cone nozzles 130 can include: a first (right) hollow cone nozzle; a second (left) hollow cone nozzle laterally offset from the first hollow cone nozzle by an offset distance; and a third (center) hollow cone nozzle centered laterally between and longitudinally offset from the first hollow cone nozzle and the second hollow cone nozzle to form a triangular layout of hollow cone nozzles, as shown in FIG. 7A. In this example, the center full cone nozzle 143 can be longitudinally offset from the first nozzle and the second nozzle by less than half of the offset distance toward an anterior end of the first member 113 such that the first, second, and third hollow cone nozzles form an isosceles-triangular layout. The first hollow cone nozzle can, thus, discharge a hollow conical spray toward a position below the showerhead 100 likely to coincide with the user's right shoulder, the second hollow cone nozzle can discharge a hollow conical spray toward a position below the showerhead 100 likely to coincide with the user's left shoulder, and the third hollow cone nozzle can discharge a hollow conical spray toward a position below the showerhead 100 likely to coincide with the user's face when the user is standing under and facing the anterior end of the showerhead 100, as shown in FIGS. 7B, 7C, and 7D.

Figure 7B:
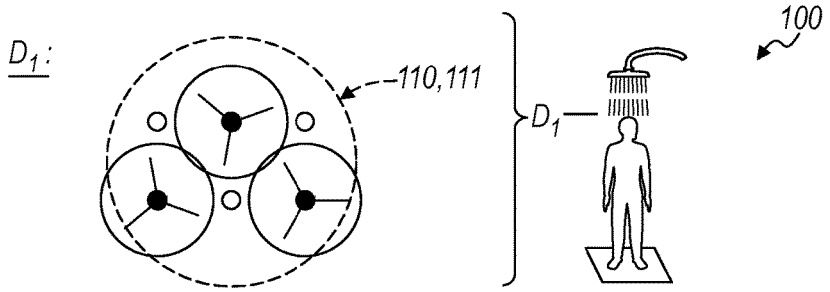
Figure 7C:
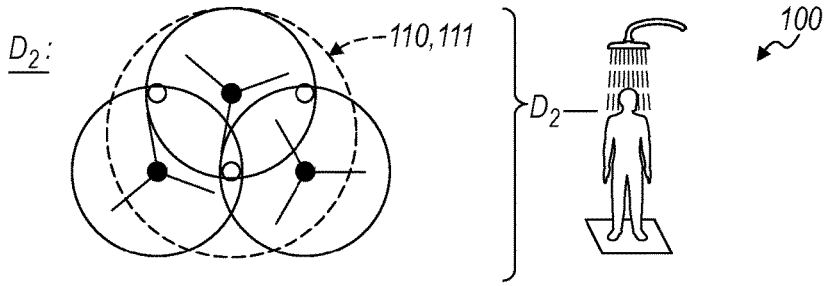
Figure 7D:
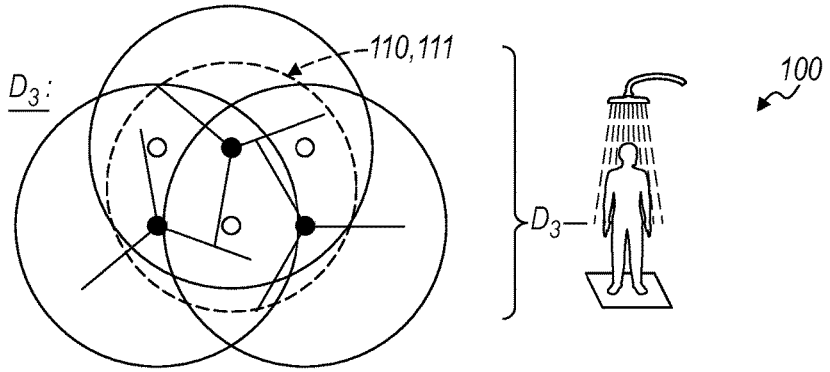

In the foregoing implementation, the first and second hollow cone nozzles can be spaced laterally across the first region 111 and can each discharge a hollow conical spray that achieves a target diameter at a target distance from the body 110 given an operating range of fluid pressures within the fluid circuit 120, as shown in FIGS. 7A, 7B, and 7C. For example, the right hollow cone nozzle 131 can be configured to discharge droplets in a pattern approximating a hollow cone that reaches approximately ten inches in diameter at a distance of twenty inches from the body 110, and the left hollow cone nozzle 132 can be similarly configured such that, when the showerhead 100 is placed at an operating distance of approximately eight inches above the user's head, the full breadth of the user's upper back (which may be approximately nineteen inches wide) and the user's shoulders (the tops of which may be approximately twelve inches below the top of the user's head) are engulfed in hollow conical sprays from the first and second hollow cone nozzles. In particular, in this example, the right hollow cone nozzle 131 can be configured to discharge droplets in a pattern approximating a hollow cone characterized by a spray angle between 27° and 31° for operating pressures between 40 psi and 45 psi in order to achieve a spray diameter of approximately ten inches at a distance of twenty inches from body; the left hollow cone nozzle 132 can be similarly configured. Furthermore, in this example, the right and left hollow cone nozzles can be substantially normal to the first region 111 and can be offset on the first region 111 by a lateral center-to-center distance of nine inches in order to achieve a one-inch spray overlap at a distance of twenty inches from the body 110. Alternatively, the first and second hollow cone nozzles can be offset on the first region 111 of the body 110 by a shorter center-to-center distance (e.g., four inches) and angled outwardly from the center of the body 110 (e.g., at an angle of 8°) to achieve a target overlap of approximately one inch at a distance of twenty inches below the body 110.

Furthermore, in the foregoing implementation, the center hollow cone nozzle 133 can be arranged ahead of the first and second hollow cone nozzles (i.e., toward the front or anterior end of the body 110) to discharge water droplets toward the user's head and chest. In one example, the left and right hollow cone nozzles define a first nozzle outlet angle, and the center hollow cone nozzle 133 defines a second nozzle outlet angle less than the first nozzle outlet angle to achieve hollow conical spray exhibiting a tighter spray angle for a particular operating pressure, and the center nozzle can, thus, focus a tighter hollow spray onto the top of the user's head, face, and chest not covered by sprays from the right and left hollow cone nozzle 132. Alternatively, the center hollow cone nozzle 133 can define a wider nozzle outlet angle to achieve a hollow conical spray characterized by wider spray angle; the center hollow cone nozzle 133 can thus discharge a hollow conical spray that reaches a greater breadth in less distance from the body 110 in order to cover a greater breadth of the user's head, which may be closer to the showerhead 100 than the user's shoulders during operation. For example, the showerhead 100 can include no more than three hollow cone nozzles (or no more than three full cone nozzles) to achieve a cloud of fine fluid droplets that engulfs the user's upper torso (e.g., from neck to upper thigh).

However, the showerhead 100 can include any other number and arrangement of hollow cone nozzles. For example, the hollow cone nozzles can be arranged in a radial configuration of three or more hollow cone nozzles, such as distributed across the first region 111 at a uniform radial distance from a center of the body 110. In another example, the hollow cone nozzles can be arranged in a linear configuration of two or more hollow cone nozzles distributed in a square or rectilinear array across the first region 111 of the body 110.

In one implementation, the showerhead 100 includes multiple hollow cone nozzles that cooperate to form a cloud of small droplets around the user. In particular, the set of hollow cone nozzles 130 can cooperate to form a discontinuous cloud of fluid droplets around the user's head and to form a continuous cloud of fluid droplets around the user's body when the user stands under the showerhead 100, such as with the showerhead 100 arranged above the user's head by an offset distance within a target offset range of six to ten inches. In this implementation, the set of hollow cone nozzles 130 can discretely discharge fluid droplet sprays that meet and coalesce at a distance from the body 110 to form a continuous cloud of fluid droplets. However, as the hollow conical sprays meet at a distance from the showerhead 100, the cloud of fluid droplets can be discontinuous in a region below the showerhead 100 up to the distance from the ventral side of the body 110, and ambient air can thus mix more readily with fluid droplets in this region. While standing under the showerhead 100, the user's head may occupy this region and may therefore be exposed to both fresh air and discrete sprays of heated fluid droplets discharged from the hollow cone nozzles. Discontinuity of the cloud of fine fluid droplets in this region may therefore provide the user with access to fresh air and thus ameliorate the user's sense of confined space in this region.

Alternatively, the set of hollow cone nozzles 130 can include a single hollow cone nozzle that defines a particular orifice size and a particular nozzle outlet angle to achieve target fluid droplet size, water droplet density, and conical spray size at a particular distance from the body 110. However, the showerhead 100 can include any other number of hollow cone nozzles of any other configuration and in any other arrangement on the body 110.

In the implementation described above in which the set of hollow cone nozzles 130 includes a right, a left, and a center hollow cone nozzle 133, the fluid circuit 120 can include a first manifold and a first set of conduits of substantially similar (or equal) lengths and cross-sections extending from the first inlet port 121 to a right, left, and center hollow cone nozzles. In particular, the fluid circuit 120 can define a set of substantially similar fluid conduits that communicate fluid from the first inlet port 121 to the set of hollow cone nozzles 130 to achieve substantially similar fluid pressure at the inlets of each hollow cone nozzle. Thus, though the hollow cone nozzles are substantially similar, this configuration of conduits from the first inlet port 121 to the set of hollow cone nozzles 130 can yield volume flow rates and spray geometries that are substantially uniform across the hollow cone nozzles, which can further yield substantially uniform wear and collection of calcium deposits across the hollow cone nozzles over time.

Alternatively, in the foregoing implementation, the first inlet port 121 can be centered over the center hollow cone nozzle 133, and the right and left hollow cone nozzles can be fluidly coupled to the inlet via a manifold or open cavity between the first inlet port 121 and the center hollow cone nozzle 133. The center hollow cone nozzle 133 can thus be exposed to a maximum fluid pressure (e.g., due to minimum head loss) and a maximum volume flow rate across the set of hollow cone nozzles 130 due to the position of the center hollow cone nozzle 133 relative to the first inlet port 121. Therefore, for the right, left, and center hollow cone nozzles that are substantially identical, the center hollow cone nozzle 133 can discharge a hollow conical spray characterized by a wider spray angle, smaller droplet sizes, and greater discharge velocity than hollow conical sprays discharged from the left and right hollow cone nozzles. For the center hollow cone nozzle 133 configured to discharge a hollow conical spray toward the user's head, the smaller fluid droplets discharged from the center hollow cone nozzle 133 can yield a higher rate of heat transfer and lower impulse into user's skin. In particular, because the user's head may be relatively close to the showerhead 100, such smaller fluid droplets discharged from center hollow cone nozzle 133 may travel shorter distances to the user's head and may therefore still retain sufficient heat and momentum over this distance—despite their reduced sizes and higher surface-area-to-volume ratios compared to droplets discharged from the left and right hollow cone nozzles—to warm and rinse the user's head. Furthermore, in this configuration, as the center hollow cone nozzle 133 may discharge these fluid droplets at a higher discharge velocity, these smaller droplets may reach the user's head more rapidly than drops discharged from the right and left hollow cone nozzles, which may similarly aid heat retention between the showerhead 100 and the user's head for these smaller fluid droplets. In this configuration, the smaller fluid droplets thus discharged from the center hollow cone nozzle 133 may also carry less momentum and may therefore be less perceptible on user's skin, particularly in areas of the human body that contain higher densities of mechanoreceptors, such as the face. The center hollow cone nozzle 133 can thus discharge a hollow conical spray of fluid droplets—smaller than those discharged from the left and right hollow cone nozzles—to produce a soft, immersive experience within the bathing environment and around the user's face.

Furthermore, the fluid circuit 120 in the foregoing configuration can yield a (slightly) reduced fluid pressure ahead of and (slightly) reduced volume flow rate through the left and right hollow cone nozzles, such as due to head loss through conduits between the first inlet port 121 and the right and left hollow cone nozzles. The right and left hollow cone nozzles can thus discharge hollow conical sprays characterized by (relatively) shallower spray angles, larger droplets, and lower discharge velocities. The right and left hollow cone nozzles can therefore discharge tighter hollow conical sprays (i.e., hollow conical sprays exhibiting narrower spray angles) that spread less per unit distance from the body 110 for improved directional control (e.g., toward the user's shoulders) than the center hollow cone nozzle 133. The larger droplets discharged from the right and left hollow cone nozzles can also exhibit lower surface-area-to-volume ratios and can therefore retain more heat over the relatively longer distance from the body 110 to the user's shoulders.

Geometries of hollow cone nozzles in the set of hollow cone nozzles 130 can additionally or alternatively be controlled to realize, exacerbate, or reduce the foregoing effects. In particular, the showerhead 100 can include nozzles of particular geometries—such as particular orifice sizes and nozzle outlet angles—that mitigate (i.e., compensate for) or intensify (i.e., exacerbate) flow rate, fluid pressure, droplet size, and/or other flow and spray characteristics described in the foregoing paragraphs to achieve particular flow and spray criteria during operation of the showerhead 100. For example, in the implementation in which the first inlet port 121 is centered over the center hollow cone nozzle 133, the center hollow cone nozzle 133 can include an orifice defining a first cross-sectional area and a first nozzle outlet angle, and the left and right hollow cone nozzles can include orifices defining a second cross-sectional area less than the first cross-sectional area and defining a second outlet angle wider than the first outlet angle. In this example, the reduced cross-sectional areas of the left and right hollow cone nozzles can yield droplet sizes that approximate sizes of fluid droplets discharged from the center hollow cone nozzle 133, and the wider nozzle outlet angles of the left and right hollow cone nozzles can yield conical sprays defining spray angles approximating the spray angle of a conical spray discharged from the center hollow cone nozzle 133 despite differences in fluid pressures ahead of the center, right, and left hollow cone nozzles due to their positions relative to the first inlet port 121. In this example, the body 110 can additionally or alternatively define a fluid circuit 120 including channels, conduits, and/or restriction plates, etc. to compensate for the position of the first inlet port 121 relative to the set of hollow cone nozzles 130, such as to balance volume flow rate, fluid droplet size, and conical spray geometry across the set of hollow cone nozzles 130 or to yield droplet sizes and conical spray geometries that vary across the set of hollow cone nozzles 130.

In another example, the center hollow cone nozzle 133 can include an orifice defining a first cross-sectional area and a first outlet angle, and the left and right hollow cone nozzles can include orifices defining a second cross-sectional area greater than the first cross-sectional area and defining a second outlet angle less than the first outlet angle. In this example, due to the increased cross-sectional areas of the left and right hollow cone nozzles, the left and right hollow cone nozzles can discharge fluid droplets of average size exceeding the average size of fluid droplets discharged from the center hollow cone nozzle 133 for a given fluid pressure at the inlet. Furthermore, due to the narrow outlet angle of the left and right hollow cone nozzles, the left and right hollow cone nozzles can discharge tighter conical sprays compared to a conical spray discharged from the center hollow cone nozzle 133 for the given fluid pressure at the inlet. Therefore, in this example, fluid droplets discharged from the left and right hollow cone nozzles can be larger and can form tighter conical sprays—relative to fluid droplets discharged from the center hollow cone nozzle 133 at the given inlet pressure—to yield greater heat retention and spray direction control over a distance from the showerhead 100 to the user's shoulders, which may be greater than a distance from the showerhead 100 to the user's head. Similarly, in this example, the geometry of the center hollow cone nozzle 133 can yield a hollow conical spray that is broader, carries less momentum, and is more immersive when it reaches the user's face compared to the hollow conical sprays discharged from the right and left hollow cone nozzles toward the user's shoulders.

However, the set of hollow cone nozzles 130 can include any other number, geometry, and arrangement of hollow cone nozzles, and the hollow cone nozzles can discharge fluid droplets of any other size and in a hollow conical spray of any other geometry.

9. Full Cone Nozzles

One variation of the showerhead 100 includes a set of full cone nozzles 140 distributed within the first region 111 of the body 110 proximal the set of hollow cone nozzles 130 and fluidly coupled to the fluid circuit 120. Generally, each full cone nozzle in the set of full cone nozzles 140 discharges fluid droplets in spray patterns approximating full cones extending outwardly from the first region 111 of the body 110. As described above, the set of full cone nozzles 140 can discharge fluid droplets in discrete mist sprays, such as mist sprays including fluid droplets of average size greater than the average size fluid droplets discharged from the hollow cone nozzles.

In the implementation described above in which the fluid circuit 120 includes a first inlet port 121 and a second inlet port 122, the set of full cone nozzles 140 can be fluidly coupled to the second inlet port 122 by the second channel 125. To complete a final rinse cycle at the end of a shower period, the second channel 125 can be opened to communicate fluid to the set of full cone nozzles 140, which can thus discharge larger droplets (at a higher volume flow rate) compared to the set of hollow cone nozzles 130. In particular, the set of full cone nozzles 140 can discharge larger fluid droplets that exhibit greater heat retention over longer distances per unit fluid volume and that maintain higher velocities up to impact with the user's skin compared to droplets discharged from the hollow cone nozzles; the full cone nozzles can therefore discharge fluid droplets that provide improved rinsing efficacy and higher fluid droplet temperatures over fluid droplets discharged from the hollow cone nozzles. The showerhead 100 can include multiple full cone nozzles that cooperate to form a cloud of water droplets that are larger and faster-moving than droplets discharged from the hollow cone nozzles, and these larger, faster-moving fluid droplets may rinse soap, dirt, and/or other debris from the user's skin faster than a cloud of smaller, slower-moving droplets discharged from the hollow cone nozzles.

As described above, the set of full cone nozzles 140 can be operated independently of the set of hollow cone nozzles 130, such as by selectively diverting flow into the first inlet port 121 and the second inlet port 122. Alternatively, the showerhead 100 can communicate fluid through the hollow cone nozzles and the full cone nozzles simultaneously.

In one implementation, a full cone nozzle—in the set of full cone nozzles 140—defines an orifice diameter exceeding that of a hollow cone nozzle and therefore discharges larger fluid droplets than the hollow cone nozzle. In this implementation, the full cone nozzle can also define wider nozzle outlet angle than the hollow cone nozzles to achieve a conical spray exhibiting a spray angle similar to that of a conical spray discharged from the hollow cone nozzle. The full cone nozzle can additionally or alternatively include an integrated restrictor plate ahead of the nozzle inlet to reduce fluid pressure at the nozzle inlet, thereby increasing droplet size and/or decreasing droplet discharge velocity. Alternatively, the fluid circuit 120 can define a longer channel, a channel of reduced cross-sectional area, and/or a restriction plate between the second inlet port 122 and the full cone nozzle to achieve such effects. As described above, the set of full cone nozzles 140 can include substantially identical full cone nozzles or full cone nozzles of various sizes and geometries, as described above. However, the full cone nozzles can define particular orifice diameters and particular nozzle outlet angles and can be arranged across the first region 111 of the body 110 to achieve particular fluid droplet sizes, particular water droplet density, and/or particular conical spray geometries at a particular distance from the body 110, such as described above for the set of hollow cone nozzles 130.

The set of full cone nozzles 140 can therefore be fluidly coupled to the second inlet port 122 via the fluid circuit 120 (e.g., the second channel 125) and can be distributed across the first region 111 according to configurations similar to those of the hollow cone nozzles described above. For example, in the implementation described above in which the set of hollow cone nozzles 130 include a right, a left, and a center hollow cone nozzle in a triangular pattern, the set of full cone nozzles 140 can similarly include a right full cone nozzle 141 adjacent an anterior end of the right hollow cone nozzle 131, a left full cone nozzle 142 adjacent an anterior end of the particular hollow cone nozzle, and a center full cone nozzle 143 adjacent a posterior side of the center hollow cone nozzle 133. In this configuration, the right and left full cone nozzles can be declined toward the posterior end of the body 110 to direct corresponding full conical sprays toward the user's shoulders, and the center full cone nozzle 143 can be declined toward the anterior end of the body 110 to direct a corresponding full conical spray toward the user's head.

Alternatively, the set of full cone nozzles 140 can be arranged on the first region 111 of the body 110, in the second region of the body 110, in a third region between the first region 111 and the second region, as shown in FIG. 10, or in any other position on the body 110 and in any other configuration, such as in a linear or radial array, as described above.

10. Flat Fan Nozzles

One variation of the showerhead 100 further includes a set of flat fan nozzles 150 arranged within the second region and fluidly coupled to the fluid circuit 120. Generally, the flat fan nozzles function to discharge fluid droplets flat fan sprays around hollow and/or full conical sprays discharged from the hollow and full cone nozzles, respectively.

In one implementation, a flat fan nozzle in the set of flat fan nozzles 150 defines a nozzle diameter greater than the nozzle diameters of the hollow cone nozzles (and the full cone nozzles) and therefore discharges larger fluid droplets than the hollow cone nozzles. The flat fan nozzle can additionally or alternatively include an integrated restriction plate—ahead of the nozzle inlet—that reduces fluid pressure at nozzle inlet, thereby increasing size and/or decreasing discharge velocity of droplets discharged by the flat fan nozzle. The fluid circuit 120 can also define a longer channel, a channel of reduced cross-sectional area, and/or a restriction plate between the second inlet port 122 and the full cone nozzle to achieve such effects of increased droplet size, decreased discharge velocity, and decreased spray angle of a flat fan spray discharged from the flat fan nozzle.

In this variation, the set of flat fan nozzles 150 can discharge fluid droplets in spray patterns approximating sheets that fan outwardly from the second region of the body 110 and intersect adjacent sheets of fluid droplets beyond a curtain distance from the body 110 to form a curtain of (larger) fluid droplets that envelopes (smaller) fluid droplets discharged from the set of hollow cone nozzles 130 (and/or from the full cone nozzles). In particular, the flat fan nozzles can discharge larger droplets in discrete flat sprays that intersect at a distance from the showerhead 100 to form a continuous curtain of larger droplets that envelopes smaller droplets discharged from the hollow cone nozzles (and/or from the full cone nozzles), as shown in FIG. 2. These larger droplets discharged from the flat fan nozzles exhibit lower surface-area-to-volume ratios and may therefore retain heat over longer periods of time and over longer distances from the showerhead 100 than the smaller droplets discharged from the hollow cone nozzles for a given ambient air temperature. Thus, the curtain formed by these larger droplets can shield smaller droplets inside the curtain from cooler ambient air (and cooler water vapor) outside of the bathing environment. In particular, the flat fan nozzles can cooperate to form a droplet barrier (e.g., an adiabatic boundary layer) around a cloud of fluid droplets discharged from the hollow cone nozzles and/or the full cone nozzles, such that heat contained in these smaller droplets persists within the bathing environment and remains available to heat the user—standing within the curtain—for longer durations.

The flat fan nozzles can also discharge these larger fluid droplets at discharge velocities less than discharge velocities of fluid droplets from the hollow cone nozzles (and the full cone nozzles) to achieve longer flight times for these larger droplets traveling from the showerhead 100 toward the floor of a shower. In particular, the full cone nozzles can define geometries that achieve droplets within a particular size range and within a particular discharge velocity range—for a given fluid pressure and fluid temperature ahead of the full cone nozzles—such that the curtain persists above a threshold temperature over a threshold distance from (e.g., below) the showerhead 100. For example, the full cone nozzles can define geometries that balance discharged droplet size and discharged velocity to achieve a target temperature drop less than a threshold temperature drop (e.g., less than 30° F.) over a target distance from the showerhead 100 (44 inches, or approximately three feet below the top of the user's head) in a room-temperature shower environment over 90% humidity for an inlet fluid pressure between 40 psi and 45 psi and for an inlet temperature between 113° F. and 120° F.

In one implementation, the set of flat fan nozzles 150 is distributed in a radial array about the second region of the body 110, as shown in FIG. 3. For example, as described above, the second member 114 can define an annular member and the set of flat fan nozzles 150 can be distributed evenly about the annular member in a radial pattern.

In one configuration, the flat fan nozzles are arranged on the body 110 at a constant radial distance from the center of the body 110 and with the radial axes of the set of flat fan nozzles 150 substantially parallel. In this configuration, the flat fan nozzles can cooperate to discharge discrete flat fan sprays that intersect and coalesce at a distance from the body 110 to form a continuous polygonal (e.g., approximately circular) curtain of width (or diameter) approximately twice the radial distance, as shown in FIG. 2.

In a similar configuration, the flat fan nozzle can be declined inwardly toward the center of the body by a characteristic dispersion angle (i.e., a spray angle along a minor axis of a flat fan spray) such that the outer boundary of each flan fan spray discharged from the fan nozzles is substantially parallel to the radial axis of the body, normal to the ventral side of the body, and/or normal to the floor of shower. For example, a flat fan nozzle in the set of flat fan nozzles can discharge a flan fan spray that disperses at an angle of 3° from the centerline of the flat fan nozzle, and the flat fan nozzle can be declined inwardly toward the center of the body at an angle of 3° to compensate for this dispersion angle.

In the foregoing configuration in which the outlets of flat fan nozzles in the showerhead 100 are declined inwardly toward the axial center of the body 110 and in which the showerhead 100 includes one discrete branch 173 and entry transition 174 (i.e., "flow path")—extended from a common manifold 172—per nozzle, the entry transition 174 of each flow path terminating at an angled flat fan nozzle can similarly decline toward the axial center of the body 110 such that fluid enters the inlet of the flat fan nozzle substantially coaxially with the flat fan nozzle.

Figure 8A:
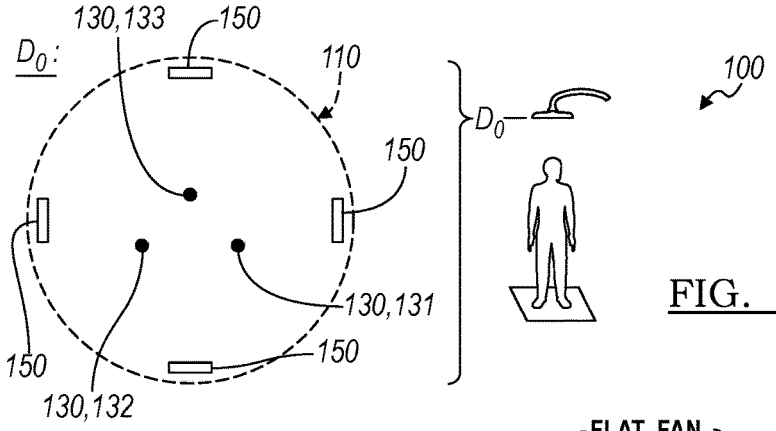
FIGS. 8A, 8B, and 8C are schematic representations of one variation of the showerhead.
Figure 8B:
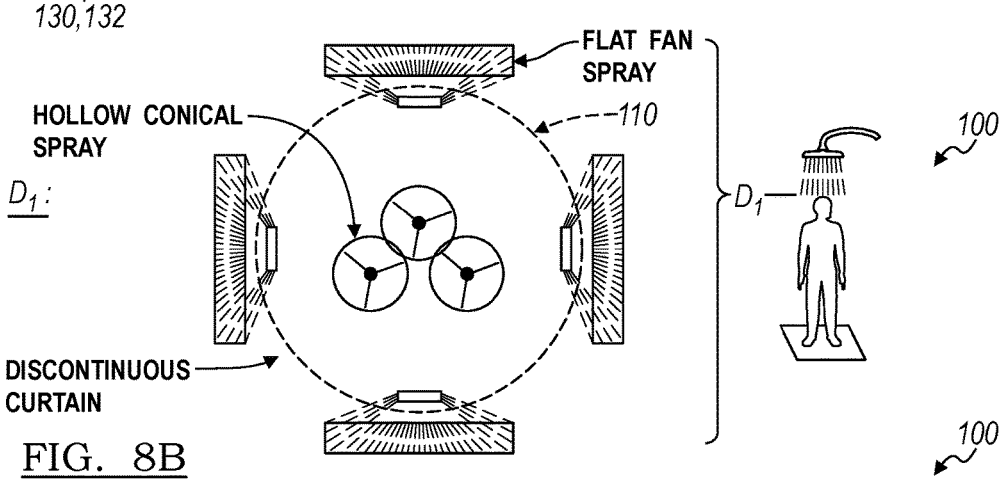
Figure 8C:
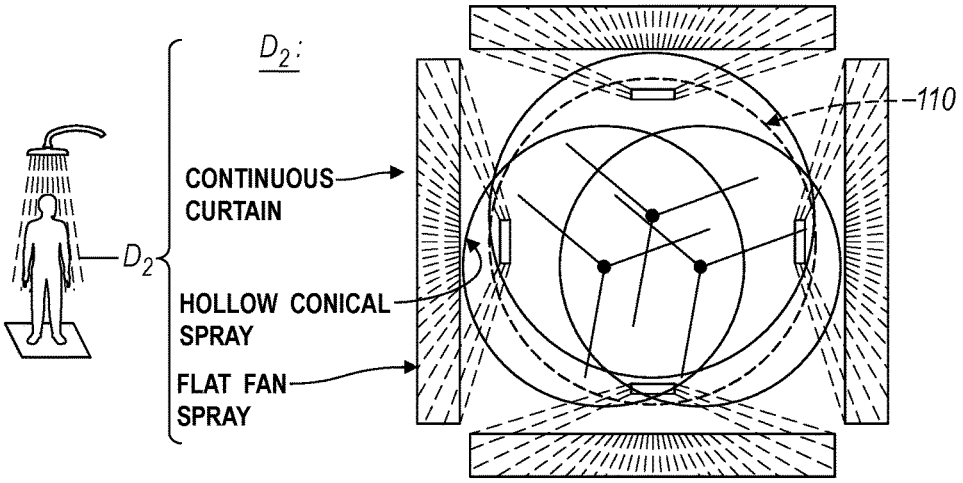

In another configuration, the flat fan nozzles are arranged about the body 110 at a constant radial distance from the center of the body 110 and with their radial axes declined outwardly from the center of the body 110 (e.g., the radial axes of the set of flat fan nozzles 150 converge above the dorsal side of the body 110). In this configuration, the flat fan nozzles can discharge flat fan sprays that fan outwardly from the body 110 and intersect and coalesce with adjacent flat sprays to form a continuous polygonal curtain of width exceeding twice the radial distance of the flat fan nozzles to the center of the of the body 110, as shown in FIGS. 8A, 8B, and 8C. Thus, in this configuration, the body 110 of the showerhead 100 can define maximum lateral and longitudinal dimensions less than a (common) width and depth of a human, and the flat fan nozzles can angle outwardly from the body 110 to form a curtain of sufficient breadth and depth—at a distance from the showerhead 100—to envelop the user's torso.

In yet another configuration, the flat fan nozzles are distributed across the body 110 at various pitch and roll angles to form a curtain that defines an approximately-ovular cross-section at a distance from the showerhead 100. In this configuration, the set of flat fan nozzles 150 can include a first (e.g., front) flat fan nozzle proximal an anterior end of the body 110 and declined toward the posterior end of the body 110 (e.g., declined at a positive pitch angle), and the first flat fan nozzle can discharge a first sheet of fluid droplets substantially parallel to a lateral axis of the body 110 and declined toward the posterior end of the body 110. The set of flat fan nozzles 150 can similarly include a second (e.g., rear) flat fan nozzle proximal a posterior end of the body 110 and declined toward the anterior end of the body 110, the second flat fan nozzle can discharge a second sheet of fluid droplets substantially parallel to the lateral axis of the body 110 and declined toward the anterior end of the body 110. Furthermore, the set of flat fan nozzles 150 can include a third (e.g., right) flat fan nozzle proximal a right side of the body 110 and declined outwardly from the body 110 and a fourth (e.g., left) flat fan nozzle proximal a left side of the body 110 and similarly declined outwardly from the body 110. The third (right) flat fan nozzle can discharge a third sheet of fluid droplets declined outwardly from the right side of the body 110, and the fourth (left) flat fan nozzle can similarly discharge a fourth sheet of fluid droplets declined outwardly from the left side of the body 110. Thus, when flat fan sprays from the first, second, third, and fourth flat fan nozzles intersect at a distance from the showerhead 100, these flat fan sprays can form a continuous curtain defining a cross-section that is approximately rectangular, wherein a long side of the rectangular cross-section of the curtain is substantially parallel to a lateral axis showerhead, and wherein a short side of the rectangular cross-section of the curtain is substantially parallel to a longitudinal axis showerhead.

In the foregoing configuration, the showerhead 100 can include additional flat fan nozzles arranged in a circular pattern on the body 110 to achieve a curtain defining a cross-section that approximates an oval. For example, the first and second flat fan nozzles can be set at angles of 0° relative to a reference axis of the body 110 (i.e., a yaw angle of 0°), the third and fourth flat fan nozzles can be set at yaw angles of 90°, and the set of flat fan nozzles 150 can further include: a fifth flat fan nozzle between the first and third flat fan nozzles and set at a yaw angle of 45°; a sixth flat fan nozzle between the first and fourth flat fan nozzles and set at a yaw angle of 135°; a seventh flat fan nozzle between the second and fourth flat fan nozzles and set at a yaw angle of 225°; and an eighth flat fan nozzle between the second and third flat fan nozzles and set at a yaw angle of 315°, as shown in FIG. 10. These eight flat fan nozzles can thus cooperate to discharge eight discrete flat fan sprays that form a curtain defining an octagonal cross-section approximating an oval at the curtain distance from the showerhead 100. However, the set of flat fan nozzles 150 can include any other number of (e.g., three, five, or twelve) flat fan nozzles arranged in any other way on the body 110.

In the foregoing configuration, the diameter of the radial array of flat fan nozzles (e.g., the maximal distance between anterior and posterior flat fan nozzles) can exceed a common depth of a human torso but can be less than a common width of a human torso. For example, for a common human torso depth of twelve inches and a common human torso width of nineteen inches, the set of flat fan nozzles 150 can be distributed in a radial array fourteen inches in diameter on the ventral side of the body 110 and according to a particular combination of pitch, yaw, and roll angles to achieve a curtain approximately 22-inches wide and thirteen inches deep at a distance of twenty inches from the body 110. In a similar example, the flat fan nozzles can be arranged on the body 110 in a radial array ten inches in diameter and can include a first, a second, a third, and a fourth flat fan nozzle; the first flat fan nozzle—proximal the anterior end of the body 110—and the second flat fan nozzle—proximal the posterior end of the body 110—can both decline outwardly from the body 110 at an angle of 15° from the vertical axis (e.g., y-axis) of the body 110 to achieve a curtain twenty inches deep at a distance of twenty inches from the body 110; and the third flat fan nozzle—proximal the right side of the body 110—and the fourth flat fan nozzle—proximal the left side end of the body 110—can both decline outwardly from the body 110 at an angle of 22.5° from the vertical axis of the body 110 to achieve a curtain twenty-five inches wide at a distance of twenty inches from the body 110.

Furthermore, each flat fan nozzle in the set of flat fan nozzles 150 can define a nozzle outlet of a particular angle to discharge a flat fan spray characterized by a particular spray angle, such that the flat fan spray spreads to a particular target width at a particular target distance from the showerhead 100. In the configuration described above in which the flat fan nozzles are distributed evenly across the body 110 and at identical angles from the central (e.g., radial) axis of the body 110, each flat fan nozzle in the set of flat fan nozzles 150 can define a substantially identical nozzle outlet angle such that flat fan sprays discharged from adjacent flat fan nozzles intersect and coalesce at substantially identical distances from the showerhead 100 (i.e., the curtain distance), thereby creating a continuous curtain of fluid droplets at a substantially uniform distance from the showerhead 100.

In another configuration in which flat fan nozzles distributed on the posterior and anterior ends of body are substantially parallel to the central axis of the body 110 and in which flat fan nozzles distributed on the lateral sides of the body 110 are declined outwardly, the anterior and posterior flat fan nozzles can each define a first (wider) outlet nozzle angle, such that flat fan sprays discharged therefrom spread to widths sufficient to meet flat fan sprays discharged from the lateral flat fan nozzles at a target distance from the body 110. In this configuration, the lateral flat fan nozzles can each define a second (shallower) outlet nozzle angle—less than the first nozzle outlet angle—such that flat fan sprays discharged therefrom spread to narrower widths to meet flat fan sprays discharged from the anterior and posterior flat fan nozzles at the target distance from the body 110, thereby forming a rectangular curtain of fluid droplets below the target distance (i.e., the curtain distance). Alternatively, in this configuration, the posterior flat fan nozzle can define a first (wider) nozzle outlet angle and the anterior flat fan nozzle can define a second (shallower) nozzle outlet angle—less than the first nozzle outlet angle—such that a flat fan spray discharged from the anterior flat fan nozzle intersects flan fan sprays from adjacent flat fan nozzles at a greater distance from the showerhead 100 than a flat fan spray discharged from the posterior flat fan nozzle, thereby forming a continuous curtain of fluid droplets that varies in starting distance from the showerhead 100. In particular, in this configuration, the set of flat fan nozzles 150 can cooperate to form a continuous curtain of fluid droplets that starts at a first (greater) distance from the showerhead 100 at the user's front and a second (shorter) distance—less than the first distance—from the showerhead 100 at the user's back. Thus, in this configuration, the flat fan sprays discharged from the flat fan nozzles can form a continuous curtain below the user's head, thereby permitting (more) cool (e.g., fresh) air to reach the user's face, and the curtain of fluid droplets can be continuous higher up the user's back, thereby retaining more heat around the user's back and neck.

The showerhead 100 can additionally or alternatively include a second set of flat fan nozzles 150, including a first subset of flat fan nozzles 150 that cooperate to form a first curtain of fluid droplets, as described above, around a full conical spray discharged from a first full cone nozzle and including a second subset of flat fan nozzles 150 that similarly cooperate to form a second curtain of fluid droplets around a full conical spray discharged from a second full cone nozzle. Furthermore, in this implementation, the second set of flat fan nozzles 150 can form discrete, smaller curtains around discrete, full conical sprays discharged from the set of full cone nozzles 140, and the (first) set of flat fan nozzles 150, as described above, can form a larger curtain of fluid droplets that envelopes the full conical sprays and the discrete, smaller curtains formed by flat fan sprays discharged from the full cone nozzles and the second set of flat fan nozzles 150, respectively.

However, each flat fan nozzle in the set of flat fan nozzles 150 can be arranged on or integrated into the body 110 in any other position, at any other pitch angle, yaw angle, or roll angle, and can define any other nozzle outlet angle to achieve a flat fan spray of any spray angle; the set of flat fan nozzles 150 can cooperate in any other way to form a curtain of fluid droplets of any other geometry below the showerhead 100 and around fluid droplets discharged from the hollow cone nozzles and/or the full cone nozzles.

As with the hollow cone nozzles and the full cone nozzles, each flat fan nozzle can define a discrete nozzle that is installed (e.g., threaded into, pressed into, bonded to) on the body 110 of the showerhead 100, such as into or over a bore in a second region 112 of body or in a second member 114 of the body 110. For example, each flat fan nozzle can include a ceramic (e.g., aluminosilicate) or bronze housing defining a bore terminating in a linear V-groove and defining an external thread that mates with an internal thread in the body 110. Alternatively, the flat fan nozzles and the body 110 can define a unitary (e.g., singular, continuous) structure, as described above. However, the flat fan nozzles can be of any other form or material and can be installed or integrated into the body 110 in any other suitable way.

11. Orifice/Injector

Figure 11A:
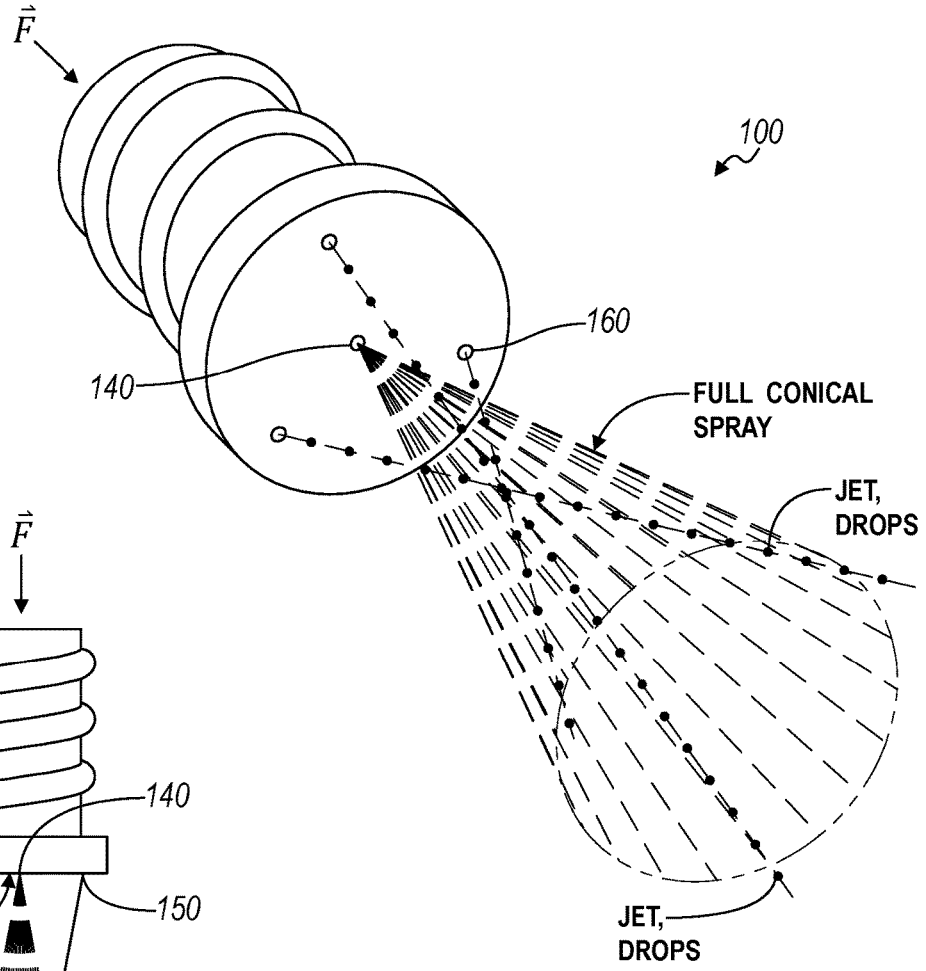
FIGS. 11A and 11B are schematic representations of one variation of the showerhead.
Figure 11B:
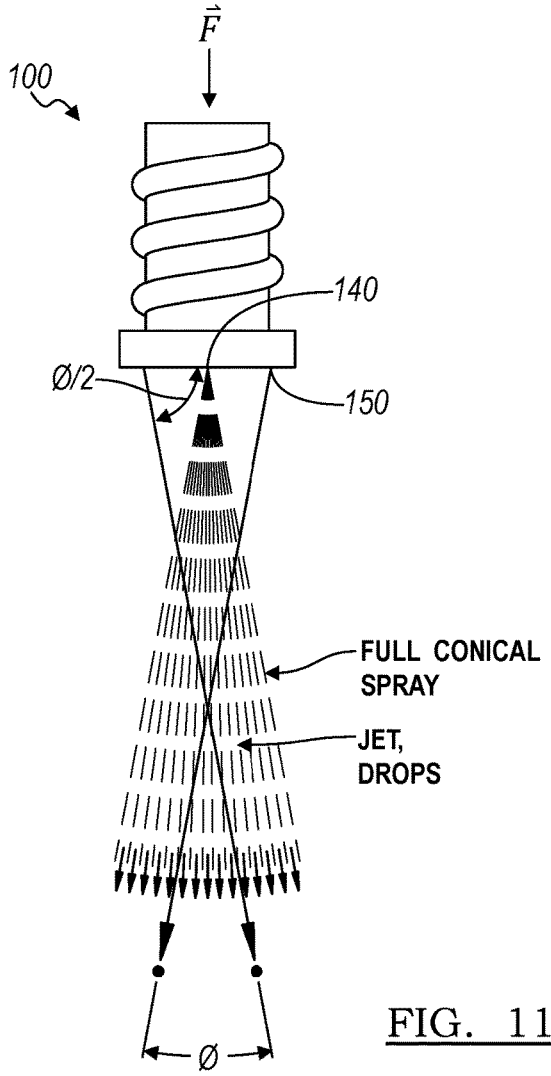

In one variation, the showerhead 100 includes one or more jet orifices 160 that inject larger fluid drops into sprays discharged from the hollow cone nozzles, the full cone nozzles, and/or the flat fan nozzles, as shown in FIGS. 1, 11A, and 11B. Generally, these jet orifices 160 function to discharge larger fluid drops that, due to their larger sizes and lower surface-area-to-volume ratios, retain more heat over greater distances from the showerhead 100 than fluid droplets discharged from the hollow cone, full cone, and flat fan nozzles. For example, the full cone nozzles can discharge fluid droplets of widths between 350 micrometers and 500 micrometers, and the showerhead 100 can include a set of orifices that discharge fluid drops of widths between 800 micrometers and 1200 micrometers in width into each full cone spray discharged from the full cone nozzles. In this example, the flat fan nozzles can discharge fluid droplets of widths between 350 micrometers and 800 micrometers, and the showerhead 100 can additionally or alternatively include a set of orifices that discharge fluid drops of widths between 600 micrometers and 3000 micrometers into each flan fan spray (e.g., into the curtain of fluid droplets) discharged from the flat fan nozzles.

In this variation, while smaller droplets discharged from the hollow cone, full cone, and/or flat fan nozzles release heat into the user and into ambient air relatively rapidly, these larger drops may transfer heat more slowly due to their size, thereby maintaining a higher average temperature within a cloud of fluid droplets and drops discharged from various nozzles and jet orifices 160 in the showerhead 100. In particular, smaller droplets discharged from the hollow cone, full cone, and/or flat fan nozzles transfer heat and cool along their trajectories from the showerhead 100. The larger drops discharged from the jet orifices 160 can transfer heat more slowly over their trajectories from the showerhead 100 and can transfer this heat into local volumes of smaller fluid droplets, thereby yielding a higher average temperature across slices or volumes of the cloud at greater distances from the showerhead 100.

In one implementation, each full cone nozzle is paired with at least one jet orifice that injects larger droplets into the full conical spray discharged from the corresponding full cone nozzle, as shown in FIGS. 9 and 10. In one configuration, a full cone nozzle—in the set of full cone nozzles 140—defines a discrete nozzle body: including a center orifice that discharges a full conical spray; and a set (e.g., three) of peripheral orifices that share an inlet with the center orifice and that each discharge a continuous jet of larger drops into the full conical spray discharged from the center orifice, as shown in FIG. 11A. In this configuration, the primary and secondary orifices can be integrated into a single nozzle body and can define parallel radial axes; the secondary orifice can thus discharge a parallel jet of drops that cross the boundary of the full conical spray at a distance from the nozzle body.

Alternatively, the secondary orifices can be declined (i.e., angled) inwardly toward the center orifice, such as at an angle approximating half of a spray angle of the conical spray of fluid droplets discharged from the center orifice—for a particular operating fluid pressure or operating fluid pressure range within the fluid circuit 120—such that jets of fluid drops discharged from the secondary orifices breach the boundary of the conical spray and then remain substantially parallel to and within the boundary of the conical spray along their trajectories from the showerhead 100 to the floor of the shower, as shown in FIG. 11B. Thus, in this configuration, the secondary orifices can be declined toward the center orifice to discharge jets of fluid drops that breach the boundary of the full conical spray—discharged from the center orifice—proximal an offset distance below the first region 111 of the body 110 such that the jets of fluid droplets remain bounded by the conical spray below the offset distance from the first region 111.

In the foregoing implementation, the showerhead 100 can alternatively include one or more discrete jet bodies, each jet body defining a jet orifice fluidly coupled to the fluid circuit 120 and configured to inject fluid drops into conical sprays discharged from discrete full cone nozzles installed in the showerhead 100. Yet alternatively, the showerhead 100 can include one or more jet orifices 160 integrated directly into the body 110 and configured to inject fluid drops into conical sprays discharged from full cone nozzles similarly integrated in the body 110.

In another implementation, the showerhead 100 includes one or more jet orifices 160 configured to inject larger fluid drops into flat sprays discharged from the flat fan nozzles. In this implementation, the jet orifices 160 can be integrated directly into flat fan nozzle bodies, integrated into the body 110 of the showerhead 100, or integrated into discrete nozzle bodies, as described above. Furthermore, the jet orifices 160 can be oriented on the body 110 relative to the flat fan nozzles, such that fluid drops discharged from the jet orifices 160 fall through a trajectory within and substantially parallel to the boundary of the curtain of water droplets formed by the flat fan nozzles, such as described above.

In this variation, the showerhead 100 can include a set of jet orifices 160 that each discharge a continuous stream of fluid drops. Alternatively, the jet orifices 160 can discharge intermittent streams of fluid drops. For example, a jet orifice—in the set of jet orifices 160—can include a single-orifice forced pulsed nozzle configured to discharge an intermittent jet, such as into a conical spray of fluid droplets discharged from a particular full cone nozzle in the set of full cone nozzles 140.

However, in this variation, the showerhead 100 can include any other number and arrangement of jet orifices 160 configured to discharge continuous and/or intermittent streams of relatively large drops into hollow conical sprays, full conical sprays, and/or flat fan sprays discharged from the hollow cone nozzles, the full cone nozzles, and/or the flat fan nozzles during operation of the showerhead 100.

As a person skilled in the art will recognize from the previous detailed description and from the figures and claims, modifications and changes can be made to the embodiments of the invention without departing from the scope of this invention as defined in the following claims.

We claim:

1. A showerhead comprising:

a body comprising:

an annular member defining a second region on a ventral side of the body; and a linear member defining a first region adjacent the second region on the ventral side of the body and extending from a first lateral side of the annular member, across a radial center of the annular member, to a second lateral side of the annular member opposite the first lateral side;

a fluid circuit within the body;

a first set of nozzles distributed within the first region, fluidly coupled to the fluid circuit, and discharging sprays of fluid droplets within a first size range according to a first spray pattern; and a second set of nozzles arranged within the second region, fluidly coupled to the fluid circuit, and discharging sprays of fluid droplets within a second size range according to a second spray pattern.

2. The showerhead of claim 1:

wherein the first set of nozzles comprises a first nozzle discharging a first conical spray of fluid droplets;

further comprising a set of orifices fluidly coupled to the fluid circuit and discharging fluid drops, within a third size range, between sprays discharged from the first set of nozzles and sprays discharged from the second set of nozzles, the third size range exceeding the first size range and the second size range; and wherein the set of orifices comprises a first orifice declined toward the first nozzle and injecting a jet of fluid drops into the first conical spray of fluid droplets proximal an offset distance below the first region of the body, the jet of fluid drops bounded by the first conical spray of fluid droplets beyond the offset distance from the first region of the body.

3. The showerhead of claim 1:

wherein the first set of nozzles discharge fluid droplets according to the first spray pattern approximating a hollow cone extending outwardly from the first region; and wherein the second set of nozzles discharge fluid droplets according to the second spray pattern approximating sheets fanning outwardly from the second region coalescing with adjacent sheets of fluid droplets beyond a curtain distance from the body to form a peripheral curtain of fluid droplets that envelopes fluid droplets discharged from the first set of nozzles.

4. The showerhead of claim 1, wherein the second set of nozzles comprises:

a first nozzle proximal an anterior end of the body and declined toward the posterior end of the body;

a second nozzle proximal a posterior end of the body and declined toward the anterior end of the body; and a third nozzle proximal a lateral side of the body and defining an axis substantially normal to an axis of the body.

5. The showerhead of claim 1, further comprising a set of full cone nozzles distributed within the first region proximal the first set of nozzles and fluidly coupled to the fluid circuit, a first full cone nozzle in the set of full cone nozzles discharging fluid droplets of widths within a third size range distinct from the first size range and the second size range.

6. The showerhead of claim 1, wherein the body comprises:

a first section defining the ventral side of the body and comprising a fiber-filled composite; and a second section defining a dorsal side of the body, fused to the first section, and cooperating with the first section to define the fluid circuit.

7. The showerhead of claim 1, wherein the first set of nozzles comprises a first hollow cone nozzle, a second hollow cone nozzle laterally offset from the first hollow cone nozzle by an offset distance, and a third hollow cone nozzle centered laterally between and longitudinally offset from the first hollow cone nozzle and the second hollow cone nozzle by less than half of the offset distance.

8. A showerhead comprising:

a body comprising a ventral side and a dorsal side, the ventral side of the body defining a set of orifices; and a fluid circuit insert housed within the body and comprising:

an inlet port configured to receive fluid under pressure;

a set of nozzles, each nozzle in the set of nozzles defining an inlet and an outlet;

a manifold extending laterally from the inlet port and defining a serpentine path of substantially uniform cross-sectional area;

a set of entry transitions, each entry transition in the set of entry transitions substantially coaxial with a nozzle in the set of nozzles and extending substantially vertically from the inlet of the nozzle toward the dorsal side of the body over a vertical length greater than a minimum vertical flow length;

a set of branches, each branch in the set of branches extending laterally from the manifold toward an entry transition in the set of entry transitions over a lateral length greater than a minimum lateral length and substantially perpendicular to axes of the set of entry transitions; and wherein each entry transition in the set of entry transitions defines a curvilinear sweep extending from tangent a corresponding branch, in the set of branches, to tangent an inlet of a corresponding nozzle in the set of nozzles.

9. A showerhead comprising:

a body defining a first region on a ventral side of the body and a second region adjacent the first region on the ventral side of the body;

a fluid circuit within the body;

a first set of nozzles distributed within the first region, fluidly coupled to the fluid circuit, and discharging sprays of fluid droplets within a first size range according to a first spray pattern approximating a cone extending outwardly from the first region of the body; and a second set of nozzles arranged within the second region, fluidly coupled to the fluid circuit, and discharging sprays of fluid droplets within a second size range according to a second spray pattern approximating sheets that fan outwardly from the second region of the body and coalesce beyond a curtain distance from the body to form a peripheral curtain of fluid droplets that envelopes sprays of fluid droplets discharged from the first set of nozzles.

10. A showerhead comprising:

a body defining a first region on a ventral side of the body and a second region adjacent the first region on the ventral side of the body;

a fluid circuit within the body;

a first set of nozzles distributed within the first region, fluidly coupled to the fluid circuit, and discharging sprays of fluid droplets within a first size range according to a first spray pattern;

a second set of nozzles:

arranged within the second region;

fluidly coupled to the fluid circuit;

discharging sprays of fluid droplets within a second size range according to a second spray pattern; and comprising:

a first nozzle proximal an anterior end of the body and declined toward the posterior end of the body;

a second nozzle proximal a posterior end of the body and declined toward the anterior end of the body; and a third nozzle proximal a lateral side of the body and defining an axis substantially normal to an axis of the body.

11. The showerhead of claim 10:

wherein the first nozzle discharges a first sheet of fluid droplets substantially parallel to a lateral axis of the body and declined toward the posterior end of the body;

wherein the second nozzle discharges a second sheet of fluid droplets substantially parallel to the lateral axis of the body and declined toward the anterior end of the body; and wherein the third nozzle discharges a third sheet of fluid droplets substantially normal to the ventral side of the body.

12. The showerhead of claim 10:

wherein the second set of nozzles discharges fluid droplets between 350 micrometers and 800 micrometers in width; and wherein the first set of nozzles discharges fluid droplets between 150 micrometers and 300 micrometers in width.

13. A showerhead comprising:

a body defining a first region on a ventral side of the body and a second region adjacent the first region on the ventral side of the body;

a fluid circuit within the body;

a first set of nozzles distributed within the first region, fluidly coupled to the fluid circuit, and discharging sprays of fluid droplets within a first size range according to a first spray pattern;

a second set of nozzles arranged within the second region, fluidly coupled to the fluid circuit, and discharging sprays of fluid droplets within a second size range according to a second spray pattern;

a set of full cone nozzles distributed within the first region proximal the first set of nozzles, fluidly coupled to the fluid circuit, and comprising a first full cone nozzle discharging fluid droplets of widths within a third size range distinct from the first size range and the second size range.

14. The showerhead of claim 13, wherein the fluid circuit restricts total volume flow rate through the fluid circuit to less than 0.9 gallons per minute.

15. The showerhead of claim 13:

wherein the body defines a first inlet and a second inlet;

wherein the fluid circuit comprises:

a first fluid channel extending from the first inlet to the first set of nozzles; and a second fluid channel extending from the second inlet to the set of full cone nozzles; and a third fluid channel fluidly coupled to the second set of nozzles, fluidly coupled to the first fluid channel.

16. A showerhead comprising:

a body defining a first region on a ventral side of the body and a second region adjacent the first region on the ventral side of the body;

a fluid circuit within the body;

a first set of nozzles:

distributed within the first region;

fluidly coupled to the fluid circuit;

discharging sprays of fluid droplets within a first size range according to a first spray pattern; and comprising:

a first hollow cone nozzle;

a second hollow cone nozzle laterally offset from the first hollow cone nozzle by an offset distance; and a third hollow cone nozzle centered laterally between and longitudinally offset from the first hollow cone nozzle and the second hollow cone nozzle by less than half of the offset distance; and a second set of nozzles arranged within the second region, fluidly coupled to the fluid circuit, and discharging sprays of fluid droplets within a second size range according to a second spray pattern.

17. The showerhead of claim 16:

wherein the third hollow cone nozzle is longitudinally offset toward an anterior end of the body;

wherein the first hollow cone nozzle, the second hollow cone nozzle, and the third hollow cone nozzle are substantially normal to the first region;

further comprising a set of full cone nozzles distributed within the first region proximal the first set of nozzles, fluidly coupled to the fluid circuit, and comprising:

a first full cone nozzle adjacent an anterior end of the first hollow cone nozzle, a second full cone nozzle adjacent an anterior end of the second hollow cone nozzle, and a third full cone nozzle adjacent a posterior side of the third hollow cone nozzle;

wherein the first full cone nozzle and the second hollow cone nozzle are declined toward the posterior end of the body; and wherein the third full cone nozzle is declined toward the anterior end of the body.

18. A showerhead comprising:

a body defining a first region on a ventral side of the body wand a second region adjacent the first region on the ventral side of the body;

a fluid circuit within the body;

a first set of nozzles:

distributed within the first region;

fluidly coupled to the fluid circuit;

discharging sprays of fluid droplets within a first size range according to a first spray pattern; and comprising a first nozzle discharging a first conical spray of fluid droplets;

a second set of nozzles arranged within the second region, fluidly coupled to the fluid circuit, and discharging sprays of fluid droplets within a second size range according to a second spray pattern; and a set of orifices:

fluidly coupled to the fluid circuit;

discharging fluid drops, within a third size range exceeding the first size range and the second size range, between sprays discharged from the first set of nozzles and sprays discharged from the second set of nozzles; and comprising a first orifice declined toward the first nozzle and injecting a jet of fluid drops into the first conical spray of fluid droplets proximal an offset distance below the first region of the body, the jet of fluid drops bounded by the first conical spray of fluid droplets beyond the offset distance from the first region of the body.

19. The showerhead of claim 18, wherein the first orifice comprises a single-orifice pulsed nozzle discharging an intermittent jet of fluid drops into the conical spray of fluid droplets discharged from the first full cone nozzle.

20. The showerhead of claim 18:

wherein the body defines a first inlet, a second inlet, and a third inlet on a dorsal side of the body; and wherein the fluid circuit comprises:

a first fluid channel extending from the first inlet to the first set of nozzles;

a second fluid channel extending from the second inlet to the second set of cone nozzles; and a third fluid channel extending from the third inlet to the set of orifices.

* * * * *